US010851633B2

(12) United States Patent
Harper

(10) Patent No.: US 10,851,633 B2
(45) Date of Patent: Dec. 1, 2020

(54) METHOD AND APPARATUS FOR RESERVOIR ANALYSIS AND FRACTURE DESIGN IN A ROCK LAYER

(71) Applicants: Ikon Science Innovation Limited, Teddington (GB); Geosphere Limited, Devon (GB)

(72) Inventor: Timothy Richard Harper, Middlesex (GB)

(73) Assignees: Ikon Science Innovation Limited, Teddington (GB); Geosphere Limited, Devon (GB)

( * ) Notice: Subject to any disclaimer, the term of this patent is extended or adjusted under 35 U.S.C. 154(b) by 192 days.

(21) Appl. No.: 15/836,018

(22) Filed: Dec. 8, 2017

(65) Prior Publication Data

US 2018/0128091 A1 May 10, 2018

Related U.S. Application Data

(63) Continuation of application No. PCT/GB2016/051739, filed on Jun. 10, 2016.

(30) Foreign Application Priority Data

Jun. 10, 2015 (GB) ..... 1510115.7
Jan. 22, 2016 (GB) ..... 1601240.3

(51) Int. Cl.
*E21B 43/26* (2006.01)
*E21B 43/119* (2006.01)
*E21B 43/16* (2006.01)

(52) U.S. Cl.
CPC ..... *E21B 43/26* (2013.01); *E21B 43/119* (2013.01); *E21B 43/16* (2013.01)

(58) Field of Classification Search
CPC ..... E21B 43/26; E21B 43/119; E21B 43/16
See application file for complete search history.

(56) References Cited

U.S. PATENT DOCUMENTS

2007/0272407 A1* 11/2007 Lehman ..... E21B 43/26 166/250.1
2008/0183451 A1 7/2008 Weng et al.
(Continued)

FOREIGN PATENT DOCUMENTS

WO 2012054139 A2 4/2012
WO 2014032003 A1 2/2014

OTHER PUBLICATIONS

International Search Report dated Dec. 14, 2016 issued in PCT/GB2016/051739.

*Primary Examiner* — Yong-Suk (Philip) Ro
(74) *Attorney, Agent, or Firm* — Perkins Coie LLP; Viola Kung

(57) ABSTRACT

A method of hydraulic fracturing of a hydrocarbon reservoir in a rock layer uses a method of providing a reservoir description. Firstly, a reservoir description is provided for the hydrocarbon reservoir. This reservoir description comprises a distribution of stresses within a rock layer affecting propagation of a hydraulic fracture. This reservoir description can be used to calculate a fracture plan to for hydraulic fracture of the hydrocarbon reservoir according to the distribution of stresses in the reservoir description to provide one or more predetermined fracture properties. Hydraulic fracturing of the hydrocarbon reservoir can then follow according to the fracture plan. A method determines minimum horizontal stress in a rock region.

19 Claims, 15 Drawing Sheets

(56) References Cited

U.S. PATENT DOCUMENTS

| | | | | |
|---|---|---|---|---|
| 2009/0125280 | A1 | 5/2009 | Soliman et al. | |
| 2014/0222405 | A1* | 8/2014 | Lecerf | E21B 43/17 703/10 |
| 2014/0246194 | A1* | 9/2014 | Artus | E21B 43/17 166/271 |
| 2016/0146963 | A1* | 5/2016 | Hall | G01V 1/42 166/250.1 |
| 2016/0341850 | A1* | 11/2016 | Lin | G06F 30/20 |

* cited by examiner (a) array 1: histogram of average distance (b) array 2: histogram of average distance (c) array 1: polar plot of means average distance by direction (d) array 2: polar plot of means average distance by direction

METHOD AND APPARATUS FOR RESERVOIR ANALYSIS AND FRACTURE DESIGN IN A ROCK LAYER

This application is a continuation of PCT/GB2016/051739, filed Jun. 10, 2016; which claims priority of GB1510115.7, filed Jun. 10, 2015; and GB1601240.3, filed Jan. 22, 2016. The contents of the above-identified applications are incorporated herein by reference in their entirety.

FIELD OF INVENTION

The present invention relates to a method and apparatus for analysis and description of a rock reservoir, particularly a sedimentary reservoir, and fracture design. Embodiments relate to description of "unconventional" sedimentary reservoirs such as shale and coal strata. Embodiments relate to the use of a reservoir description for fracture design, particularly for hydraulic fracturing to release trapped hydrocarbons.

BACKGROUND TO THE INVENTION

Hydraulic fracturing is a method primarily used for increasing the area available for flow from reservoir to well for a well drilled in a low permeability sedimentary reservoir. Hydraulic fractures grow primarily in a single plane (or generally elliptical zone) with one 'wing' of the fracture to either side of the injection point (in what is termed the "perforated section" of a well). Conventional reservoirs (such as sandstones) typically require only one hydraulic fracture per well. Shales and coal reservoirs typically have a much lower permeability. Each shale well therefore requires many hydraulic fractures to achieve the necessary surface area for flow. In order to achieve sufficient area for effective flow to the well in a shale (or other unconventional) reservoir it is often necessary to intersect clusters of natural fractures thus providing additional surface area. Most shale reservoirs are naturally fractured to some extent.

Shales—sometimes termed mudrocks, mudstones, or claystones—have been historically regarded as of such low permeability that they could act only as hydrocarbon source rocks and seals for hydrocarbon accumulations. As source rocks, they can contain hydrocarbon at the present day. They are now described as "unconventional reservoirs" because they are of such low permeability that traditional drilling and well completion methods did not release hydrocarbon effectively. Until quite recently it was not recognised that hydrocarbon could be extracted at commercial rates from reservoirs of such low permeability. A significant development was in the technology of horizontal drilling. Shale reservoirs are typically highly heterogeneous. It should be noted that in the art the term "shale" when describing a reservoir is used to describes rocks other than a geological shale—rocks that are substantially carbonates (such as shales or mudstones that have been substantially remineralised to form carbonates) may also be described as "shale reservoirs". Coals often have very low permeability and commercial production of gas often depends upon hydraulic fracturing, so these are also included in the class of reservoirs known as unconventional reservoirs.

The technology of hydraulic fracturing has evolved over a period of 50 years in conventional reservoirs and 10 to 15 years for wholly or partly unconventional reservoirs. More than a million hydraulic fractures have been created in the US alone to date, and the technology has long been adopted globally.

Certain aspects of hydraulic fractures are well understood, and a conventional approach to hydraulic fracturing has developed as discussed below.

In conventional reservoirs, hydraulic fractures are normally elliptical and planar, with the long axis of the ellipse horizontal. This disposition is shown in FIG. 3 with hydraulic fracture growth stages being shown for growth of a hydraulic fracture 2 about a vertical well 1. Hydraulic fractures are generally assumed to be symmetric about the well and this assumption has generally been considered acceptable for well design purposes.

The reservoir feature considered to provide the main control on fracture height has generally been considered to be the difference in stress (stress 'contrast') between the reservoir and the sedimentary layers above and below the reservoir. Stress contrasts are accepted as the most influential feature of a reservoir controlling upward or downward height growth. Practitioners sometimes refer to 'mechanical stratigraphy'—this means that geomechanical properties and stress state vary according to the sedimentary layering—practitioners typically allocate single values of stress to each layer or group of layers in preparing geomechanical models (known as 'mechanical earth models').

A main factor controlling fracture length is considered to be the leak-off of fracturing fluid through the walls of the propagating hydraulic fracture. In some situations, fracture lengths are governed by the magnitude of the stress contrast between layers preventing upward or downward growth (height growth) because upward or downward growth limits or reduces the fluid pressure within the hydraulic fracture, thus inhibiting length growth outwards into the reservoir. Height growth is normally considered to be undesirable.

The philosophy of hydraulic fracture design in conventional reservoirs is to balance the area of the hydraulic fracture (which governs inflow from the reservoir) which can be reasonably achieved with the permeability of the (propped) hydraulic fracture to maximise well productivity gain. For conventional reservoirs this approach has been typically deterministic, the design being chosen to achieve a satisfactory well productivity gain. Wells are most commonly drilled vertically within a reservoir and spaced according to the estimated drainage radius of each well (hydraulically fractured or otherwise).

The position for unconventional reservoirs is more complex, but the approach taken is essentially similar.

In unconventional reservoirs, hydraulic fractures may be planar, ellipsoidal or a combination of both shapes. As shown in FIG. 4, hydraulic fractures 2 are often asymmetric about a well and are otherwise asymmetric.

The primary factor controlling fracture length has traditionally been thought to be transport of fracture fluid into natural fracture systems (sometimes described as fracture fluid leak-off), limiting fracture length in both conventional and uncovential reservoirs. In unconventional reservoirs, the leaking off of fluid into natural fractures may be desirable In some cases, when natural fractures are not intersected, lateral propagation to long distances with minimal leak-off may occur in unconventional reservoirs. The loss of fracture fluid through the very low permeability fracture walls when natural fractures are not present is minimal.

The primary reservoir feature controlling fracture height has been assumed to be the difference in stress between the reservoir and the sedimentary layers above and below the reservoir. Blunting or deflection of the fracture tip at bedding planes causing temporary, permanent or offset fracture height growth has also been recognised as a secondary natural feature which can control reservoir height. Because of the composition and mechanical characteristics of unconventional reservoirs this effect is more likely to occur in unconventional than conventional reservoirs.

Most shale reservoirs are naturally fractured. The philosophy of hydraulic fracture design for shale reservoirs relates to the achievement of the maximum possible reservoir free surface area by means of created and natural fractures which are connected to the well. Propped (i.e. permeable) fracture area is a consideration, as for conventional reservoir hydraulic fracturing, but proppant transport in shale reservoirs is much less predictable and the slurry concentrations used in practice are lower in order to avoid abrupt pressure rises and termination of the treatment (known as "screen out"). Shale reservoirs are of such low permeability that each hydraulically fractured interval along the well has a very low value of drainage radius. To counteract this, a fracture pattern, comprising many hydraulic fractures, is created at short intervals along a horizontal well with the intention of producing hydrocarbon from all the penetrated intervals. In practice it is found that the production from each of the hydraulically fractured intervals is very different—a commonly quoted approximation is that 70% of the production is produced by 30% of the fracture stage intervals.

As for conventional reservoirs, the design philosophy for shale reservoirs has been typically deterministic, the design of multiple fractures being chosen to achieve a satisfactory well productivity gain by means of intersecting networks of natural fractures to achieve a large area of contact with the reservoir. Wells are normally drilled horizontally and often spaced according to twice the expected half length of the hydraulic fractures extending from adjacent wells. The intention is to:

1. drain the reservoir without leaving areas between the wells which are undrained; and
2. avoid fracture overlap, because the entry of fracture fluid into previously reactivated fracture networks can reduce the productivity of the previous well.

Consequently, well spacing depends upon a prior calculation of hydraulic fracture length. However, as discussed above, the practical effects of individual hydraulic fractures vary significantly from fracture to fracture. It would be desirable to understand why such variability occurs in unconventional reservoirs, and to be able to design patterns of hydraulic fractures in unconventional reservoirs for efficient and effective reservoir drainage.

SUMMARY OF THE INVENTION

Accordingly, in one aspect the invention provides a method of hydraulic fracturing of a hydrocarbon reservoir in a rock layer, the method comprising: providing a reservoir description for the hydrocarbon reservoir, the reservoir description comprising a distribution of stresses within a rock layer affecting propagation of a hydraulic fracture; calculating a fracture plan to for hydraulic fracture of the hydrocarbon reservoir allowing for the distribution of stresses in the reservoir description to provide one or more predetermined fracture properties; and hydraulic fracturing of the hydrocarbon reservoir according to the fracture plan.

The distribution of stresses may comprise a two-dimensional distribution laterally within the the rock layer. The distribution of stresses may comprise a distribution of a plurality of stress chains, wherein the stress chains comprise channels of high stress.

The fracture plan may comprise location of a plurality of puncturing points to initiate hydraulic fracturing. It may further comprise a plurality of fracture stages wherein each fracture stage is to be fractured separately, the fracture plan comprising a start point and an end point for each fracture stage, possibly specifying location of the puncturing point or points within each fracture stage.

The fracture plan may comprise determining a drillbore direction in the rock layer—the drillbore direction may be substantially parallel to the channels of high stress.

Providing a reservoir description may involve determining a geomechanical state for the hydrocarbon reservoir and performing geomechanical simulations to determine a probabilistic distribution of the plurality of stress chains. The geomechanical state may be determined from data including drilling logs and core samples, from data including a stress history simulation, from data including fracture distribution models—it may be partly determined by data from adjacent wells and partly determined by adjacent hydraulic fractures.

In embodiments, the rock layer is a sedimentary layer, such as a shale layer.

In a second aspect, the invention provides a method of providing a reservoir description for a hydrocarbon reservoir in a rock layer, the reservoir description comprising a distribution of stresses within a rock layer affecting propagation of a hydraulic fracture, wherein the distribution of stresses comprise a distribution of a plurality of stress chains, wherein the stress chains comprise channels of high stress, the method comprising determining a geomechanical state for the hydrocarbon reservoir and performing geomechanical simulations to determine a probabilistic distribution of the plurality of stress chains.

In a third aspect, the invention provides a method of determining minimum horizontal stress in a rock region with depth, the method comprising:

interpreting from in situ measurements an original set of stress values at a plurality of points in the rock region;

determining a distribution of stresses in the rock region with depth; and determining a modified set of stress values by applying the determined distribution of stresses in the rock region with depth to the original set of stress values; and calibrating the stress values in the modified set of stress values to determine a minimum horizontal stress in the rock region with depth.

The modified stress values may be provided through providing an uncertainty for the stress values in the set, or through removing anomalous stress values from the set, or both.

BRIEF DESCRIPTION OF THE DRAWINGS

Specific embodiments of the invention will now be described, by way of example, with reference to the accompanying drawings, in which.

DETAILED DESCRIPTION OF THE EMBODIMENTS

Figure 1:
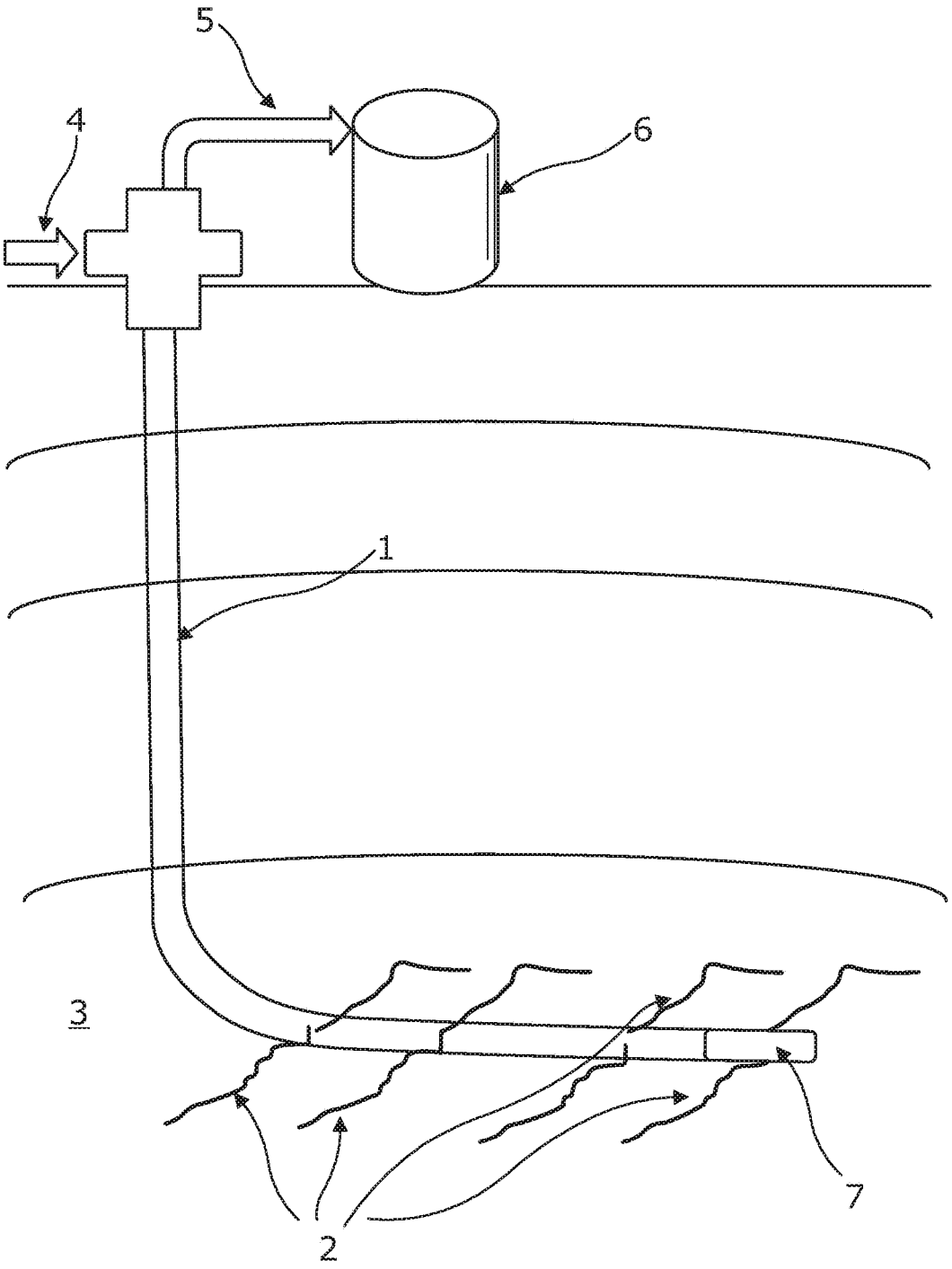
FIG. 1 is an illustration of hydraulic fracturing of an unconventional sedimentary reservoir to release trapped hydrocarbons.

FIG. 1 shows the elements of a typical hydraulic fracturing process. A wellbore 1 is drilled initially vertically and then horizontally through the reservoir of interest—in this case, an unconventional reservoir such as a shale stratum 3. A suitable hydraulic fluid is injected 4 into the wellbore for hydraulic fracturing—this will typically be mainly water but will contain a proppant (a particulate medium permeable to gas and other hydrocarbons that is adapted to keep open an induced fracture) and possibly other chemicals.

Multiple hydraulic fractures 2 are made in the wellbore 1 to allow access to hydrocarbons held in the shale stratum 3—these hydrocarbons are released to pass back up through the wellbore 1 and are then conveyed 5 out of the wellbore 1 and into storage tanks 6 or a pipeline. While these hydraulic fractures 2 are shown as one-dimensional in FIG. 1, in practices they are substantially ellipsoidal, ideally with a smallest axis vertical (as a result, broadly planar). In older hydraulic fracturing, fractures are achieved simply by building up sufficient pressure that one fracture occurs—for an unconventional reservoir, this may require very large fluid volumes to open many fractures. In a conventional reservoir, only one fracture may be needed but in unconventional reservoirs it will generally be necessary to use multiple fractures to release hydrocarbons effectively. It is thus desirable to plan fracture positions, typically by fracturing in separate horizontal stages, generally sequentially. A fracturing port 7 to achieve fracturing in a stage is shown associated with a particular hydraulic fracture—an exemplary technology is shown in R. Seale, "Open hole completion systems enables multi-stage fracturing and stimulation along horizontal wellbores"; Drilling Contractor July-August 2009, pp. 112-114, though the skilled person will appreciate that any other suitable technology could be used with embodiments of the invention as described below.

Figure 8:
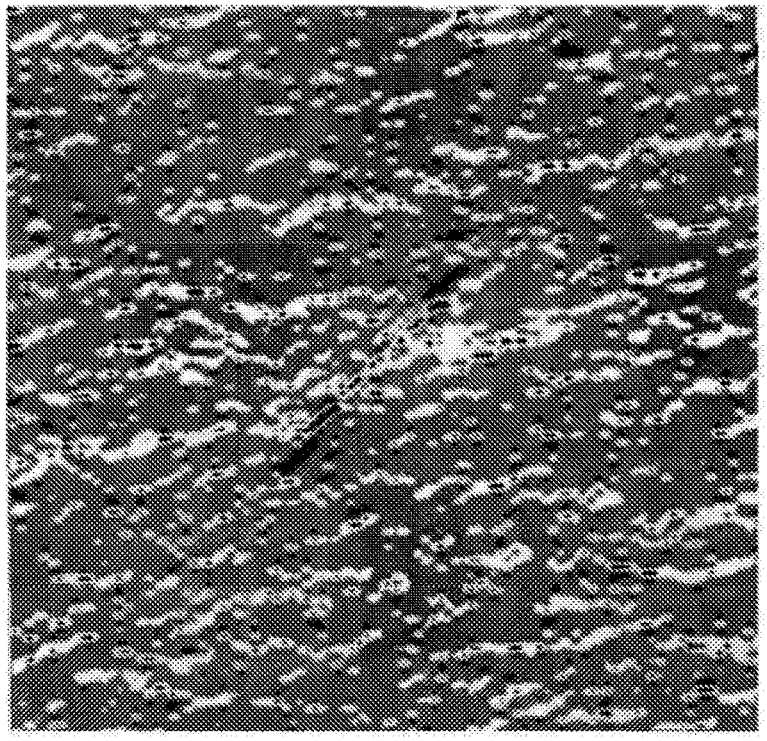
FIG. 8 provides a plan view of stress chains in a hypothetical sedimentary reservoir.

The present inventor has understood that conventional descriptions of sedimentary reservoirs have not appreciated the significance of a naturally occurring reservoir characteristic not previously identified as relevant to hydraulic fracturing. This is the existence of "stress chains" ("force chains" acting on an area) created by interaction between slipped natural fractures. These stress chains are channels of high and low stress. Exemplary stress chains are shown in FIG. 8, which provides a plan view of a 1 km by 1 km region in a hypothetical (modelled) reservoir. FIG. 8 is contoured based on regions of minimum horizontal stress, with intervals of 2 MPa (290 psi). Channels running in a broadly east-west orientation can be clearly seen in the Figure.

Previously, it has been generally assumed that stress varies according to sedimentary layering—that is, for practical purposes it could be taken that there was only variation in stress along lines normal to the bedding, such as the axis of a typical vertical well (one-dimensional variation). The present inventor has recognised that stress typically varies by a comparable amount in suitably fractured unconventional reservoirs along lines parallel to the bedding, such as the axis of a typical horizontal well. In conjunction with the recognised variation provided by sedimentary layering, this results in a minimum of a two-dimensional variation in the magnitude of the minimum stress. This is a consequence of the stress chains described here.

Force chains are not an unknown phenomenon—they have been recognised as a local phenomenon in porous media and stress heterogeneity has been recognised in blocky media. Here it is appreciated that stress chains may occur in discontinuously fractured media, which is a situation believed to be commonly applicable to unconventional reservoirs. A process for prediction of the distribution of stress chains in an unconventional reservoir will be described further below.

Figure 9:
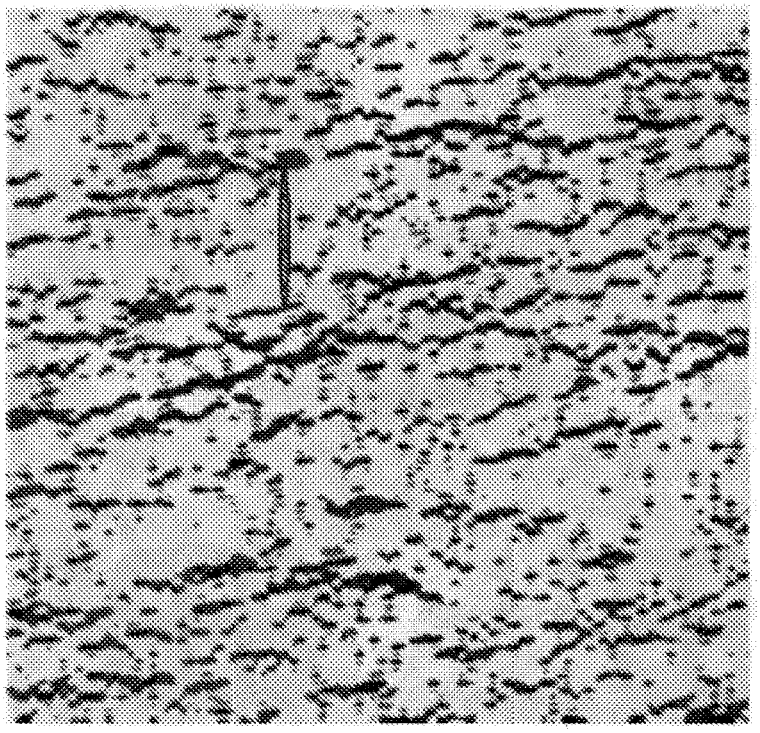
FIG. 9 shows alignment of stress chains at an oblique angle to the plane of fracture growth, as indicated by an illustrative fracture.
Figure 10:
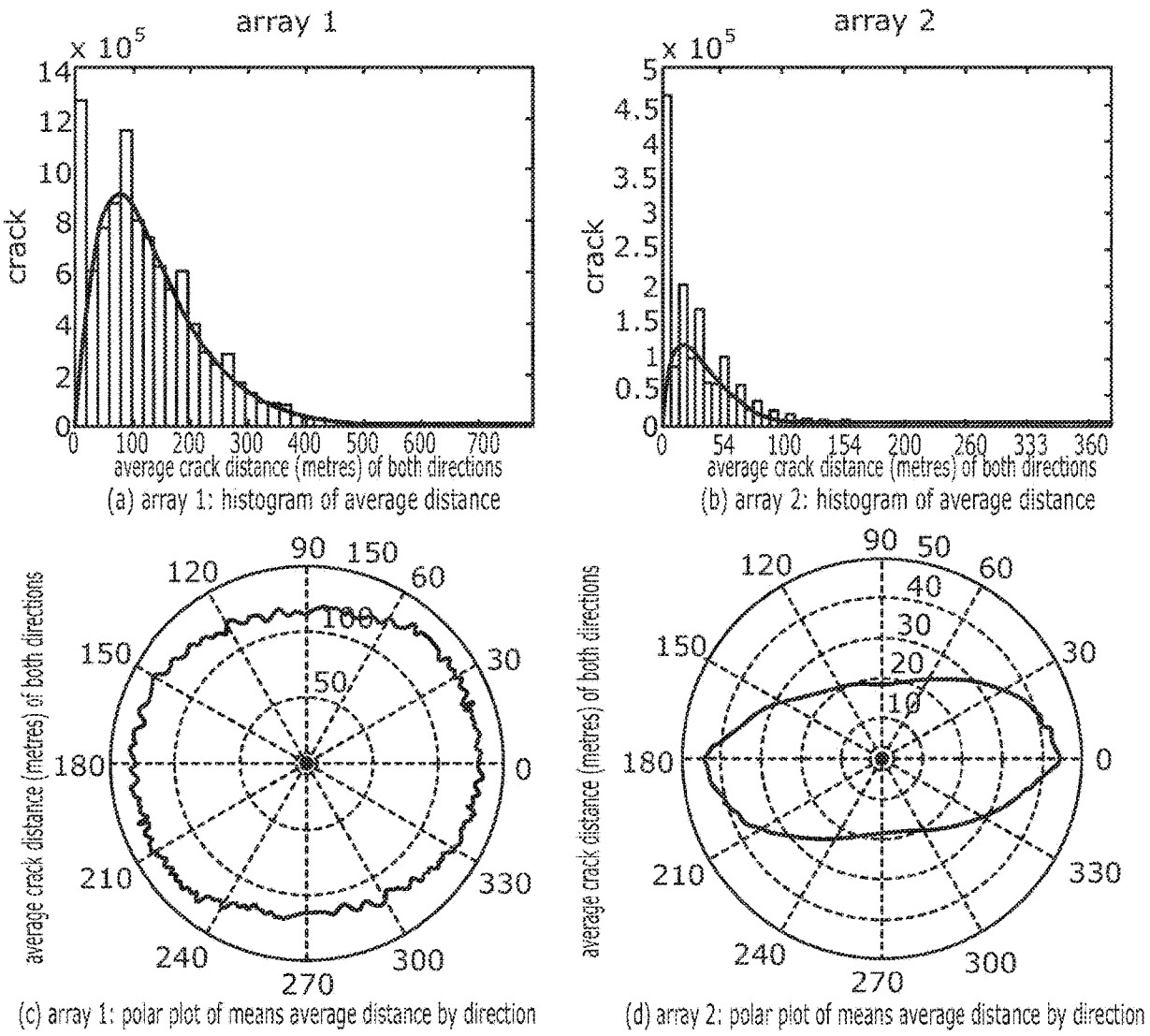
FIG. 10 depicts a statistical description of the spacing between stress chains of a specified minimum magnitude, which enables a distribution of hydraulic fracture lengths in the presence of force chains to be inferred.

It is found through simulation that the stress chains are generally aligned oblique and at a high angle to the planes of induced hydraulic fractures (FIG. 9). These stress chains:

1. Are of a comparable (may be greater) magnitude to the stress contrasts known to control height growth in conventional reservoirs; and
2. Are distributed in a manner which is statistically predictable (FIG. 10—this show a statistical description of the spacing between stress chains of a specified minimum magnitude, which enables a distribution of hydraulic fracture lengths in the presence of force chains to be inferred) from measurements and seismic and wellbore images either normally or potentially acquired in practice for purposes of reservoir description, analysed by a suitable computational mechanics code; and
3. Are modified by previous hydraulic fractures.

A statistical (probabilistic) description such as that indicated in point 2 above is amenable to uncertainty (risk) analysis. Additionally, the creation of multiple fractures along a single horizontal wellbore provides the opportunity to acquire data to reduce the uncertainty in fracture distribution. A statistical analysis admits the potential for other, completely different, parameters which affect the uncertain outcome of hydraulic fracturing (e.g. economic parameters) to be incorporated in a probabilistic design rather than the deterministic designs traditionally used for conventional reservoirs.

It is found that variation of the intact rock elastic properties can also result in some variation (heterogeneity) of stress state, but the stress heterogeneity so derived is minor compared to the effect produced by interacting natural fractures.

This characteristic exists in conventional reservoirs, but is of far greater practical significance in unconventional reservoirs because of their lower permeability and typically higher incidence of natural fractures. This phenomenon has a number of effects of great practical significance for fracture propagation in unconventional reservoirs, as shown in FIGS. 5 to 7, 11*a* to 11*d* and 12*a* to 12*c*.

Figure 5:
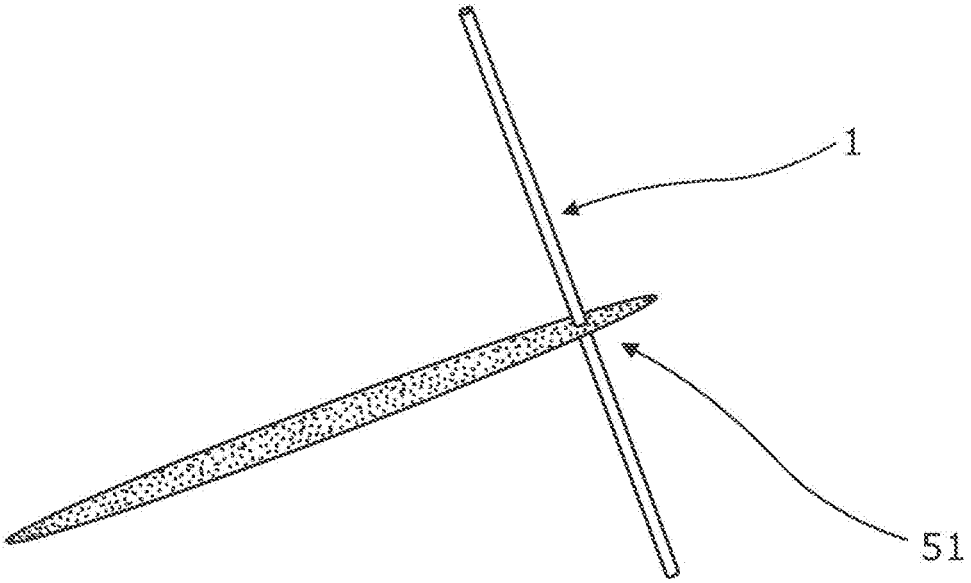
FIG. 5 provides a plan view of a hydraulic fracture grown asymmetrically about a wellbore.

In an unconventional reservoir, force chains provide a significant control of fracture length. One result of this is that there will be a maximum tip-to-tip fracture length that can be achieved without height growth which is not controlled by fracture fluid leak-off. A second result is that eccentricity about the wellbore, as shown in FIG. 5, is a usual occurrence. A third result is that fracture length restriction commonly induces fracture height growth—a contrasting phenomenon to that noted in fracturing in conventional reservoirs, where undesirable fracture height growth acts as a control on fracture length growth.

A consequence of the second result, shown in FIG. 5, is that there is a restricted aperture 51 at the wellbore 1 compared to that which would be achieved if the fracture grew symmetrically about the wellbore 1. This results in a higher net treating pressure—which may lead to height growth or induce seismicity, and also may limit well productivity. There will also be asymmetric transport of proppant away from the wellbore 1, which could also affect well productivity.

Figure 6:
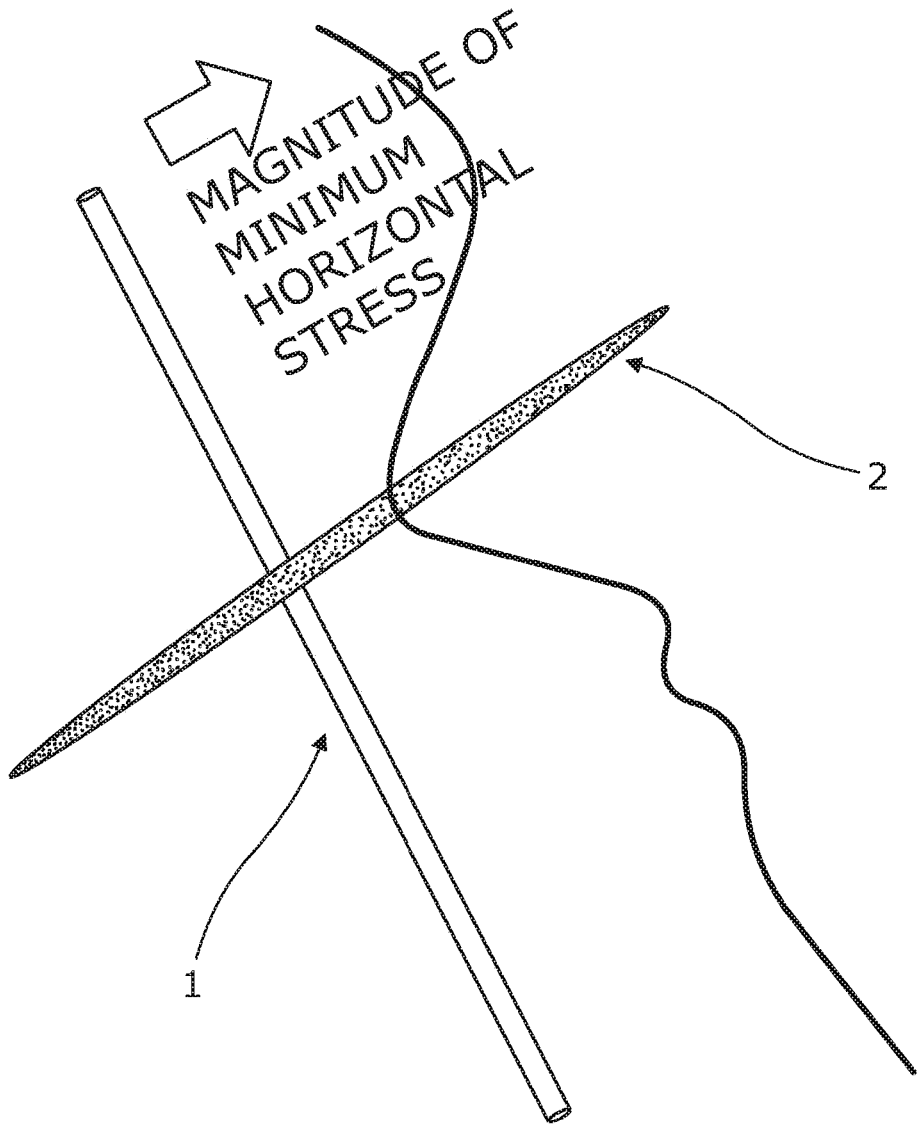
FIG. 6 illustrates in plan view fracture growth from a point of lowest minimum stress in a single bed.

As is shown in FIG. 6, this reservoir characteristic may control location of the fracture within a fracture stage. FIG. 6 shows location of a fracture 2 grown from a point of lowest minimum stress—force chain control of stresses in a bed that would conventionally be assumed to be of constant minimum stress leads to specific locations where fracture will be initiated. This same characteristic can result in low net pressure (compared to other locations along the wellbore 1) at the perforation points, thus limiting both fracture length and proppant transport distance, both of which may affect the productivity of the well.

Figure 11A:
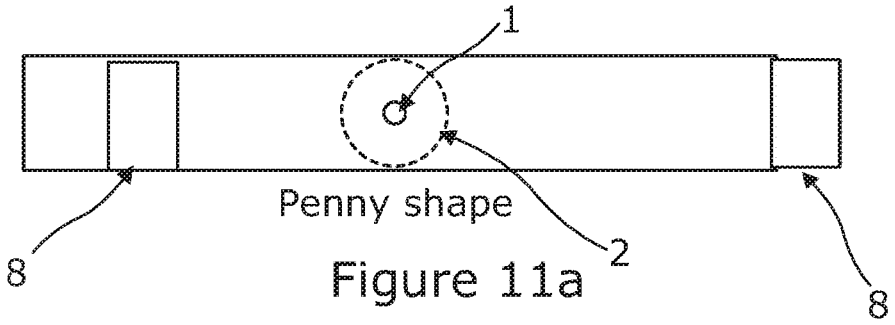
FIGS. 11*a* to 11*d* provide cross-sectional views of fracture evolution in the presence of force chains providing a horizontal constraint on growth.
Figure 11B:
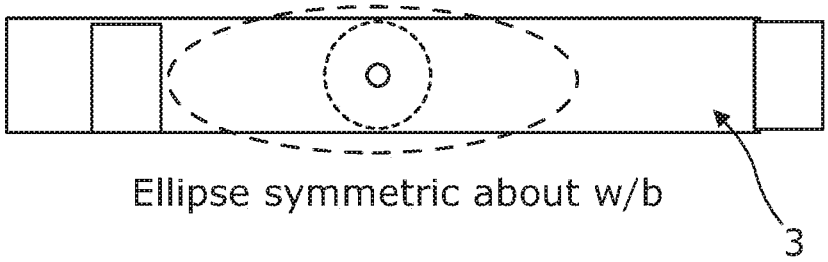
Figure 11C:
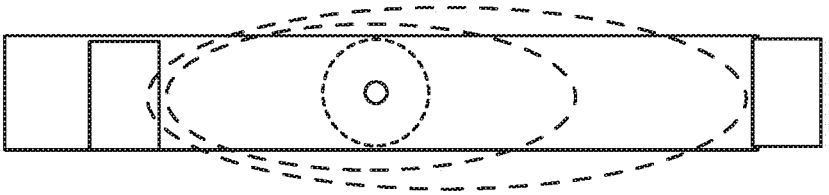
Figure 11D:
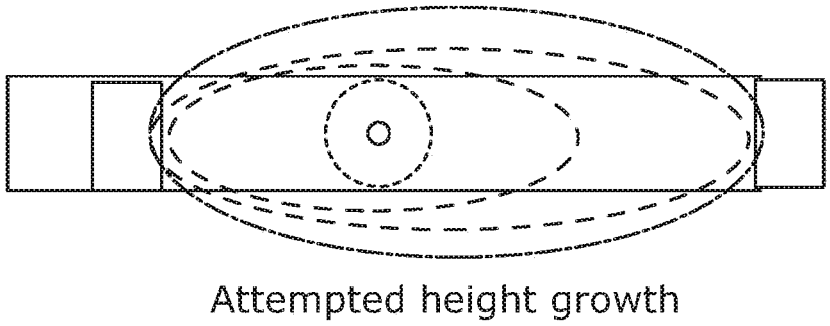

Fracture evolution in the presence of force chains is illustrated in FIGS. 11*a* through 11*d*. These figures show force chains 8 around a wellbore 1, with dashed lines indicating successive perimeters of an evolving fracture 2. FIG. 11*a* shows a penny shaped fracture 2, unaffected by force chains or adjacent layers and so conforming to a conventional fracture model. FIG. 11*b* shows elliptical growth broadly confined to a shale stratum 3. FIG. 11*c* shows the effect contact with a force chain 8, which curtails growth in one direction leading to asymmetry about the wellbore 1. FIG. 11*d* shows contact with force chains 8 at each tip of the fracture 2, resulting in attempted height growth.

Figure 12A:
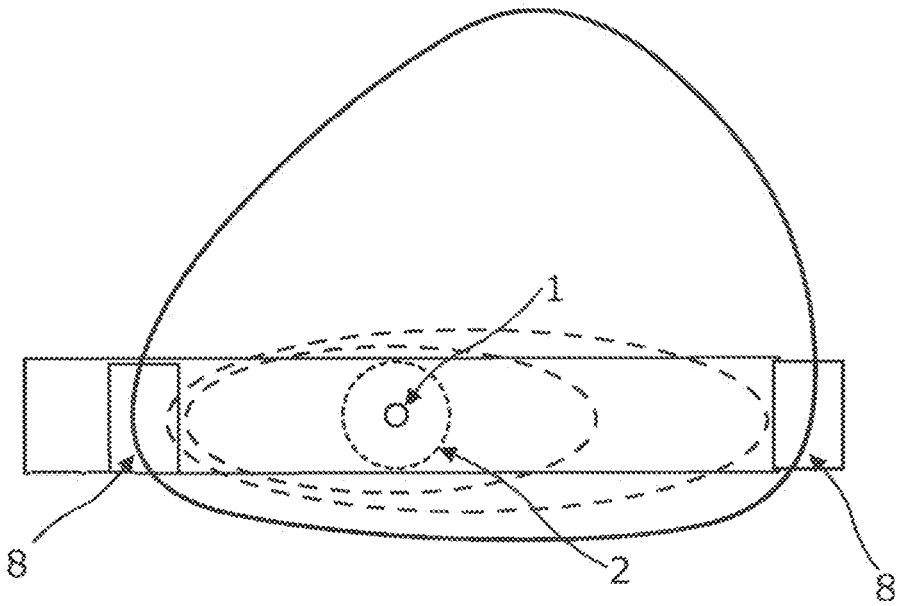
FIGS. 12*a* to 12*c* provide cross-sectional views of developed fractures following fracture evolution as shown in FIGS. 11*a* to 11*d;*
Figure 12B:
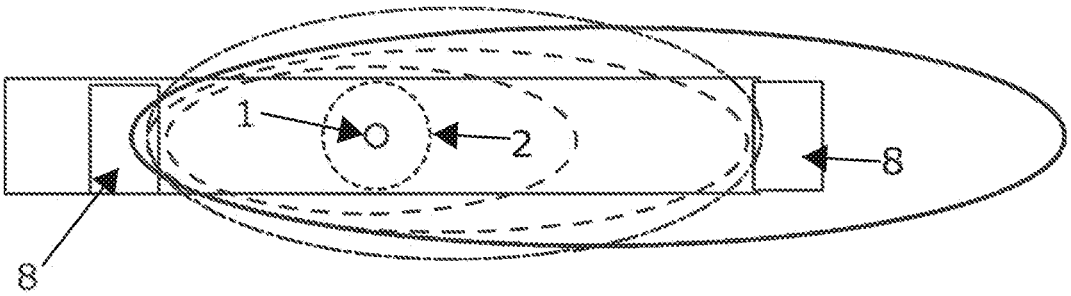
Figure 12C:
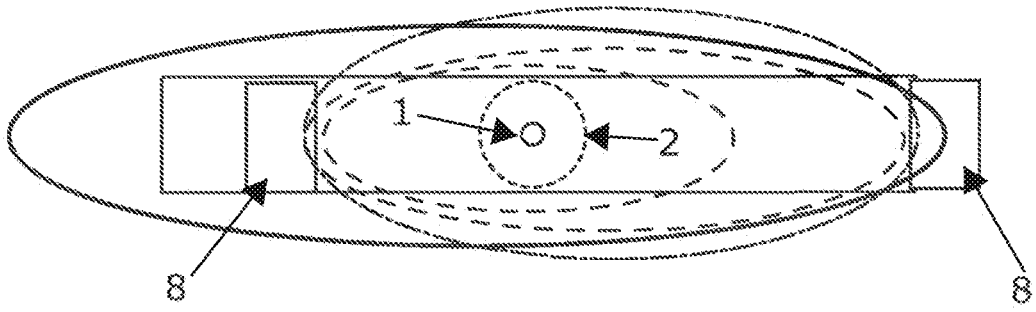

A number of different evolved fracture states are possible, as shown in FIGS. 12*a* to 12*c*. FIG. 12*a* shows a configuration in which the fracture has been stopped by force chains 8 to either side at different stages in evolution, with a resulting assumed asymmetric height growth and an offset between the injection point and the wellbore 1. In this case the limiting of lateral fracture growth by the force chains 8 has resulted in a higher relative pressure at the perforation point, leading to unwanted height growth along with a limited fracture length.

FIG. 12*b* shows a fracture stopped by a force chain 8 to one side but on the other side the fracture 2 has subsequently met and broken though the force chain—the wellbore 1 is located highly asymmetrically within the fracture 2 as a result. FIG. 12*c* shows a case where the fracture 2 has broken through the first force chain 8, but has been stopped by a second force chain 8 to the other side—in this case the wellbore 1 is located approximately centrally within the elliptical fracture, but the fracture 2 is pinched on one side.

Figure 7:
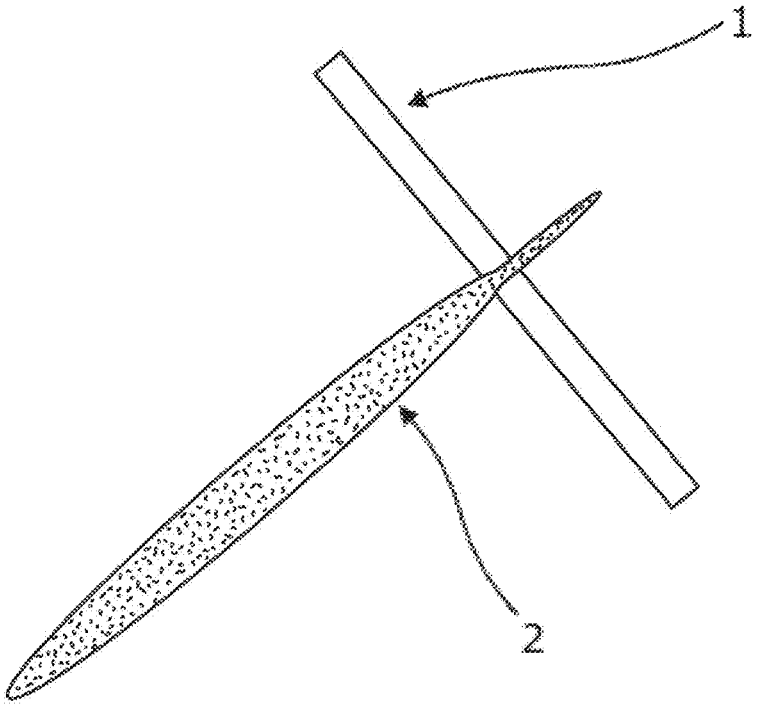
FIG. 7 illustrates narrowing of a fracture at intersection with a stress chain.

As seen in FIGS. 12*b* and 12*c*—also shown explicitly in FIG. 7—when a fracture 2 brakes through a force chain 8 this can result in narrowing of fracture apertures laterally away from the wellbore 1 (and also vertically). This aperture narrowing detrimentally influences fracture propagation and proppant transport and the potential for height growth.

The presence of force chains can thus lead to irregular apertures in hydraulic fractures in shales and other unconventional reservoirs. This irregularity may be immediate in the way that the fracture is propagated, or may grow as a result of reduced effectiveness in providing proppant to the fracture.

The presence of force chains thus has significant effects on the effectiveness of hydraulic fracturing. There can thus be significant benefits in being able to make statistical predictions about force chain distribution. In particular, prediction of the statistical distribution (magnitude, spacing, continuity) of force chains will provide a greatly improved basis for hydraulic fracture design in unconventional reservoirs. The consequences of improved reservoir descriptions which include a statistical prediction of the force chains are as follows.

Force chain prediction will improve the chances of selecting 'sweetspots' in unconventional reservoirs by distinguishing between reservoirs where fracture propagation is severely constrained by force chains from those where fracture propagation is not so constrained.

Well spacing can be selected more effectively. Two factors contribute to this in particular—one is the possibility of making a more representative calculation of fracture half-lengths, and the other is the recognition of the asymmetry of fracture growth as shown in FIGS. 11*a* to 11*d*.

Figure 13A:
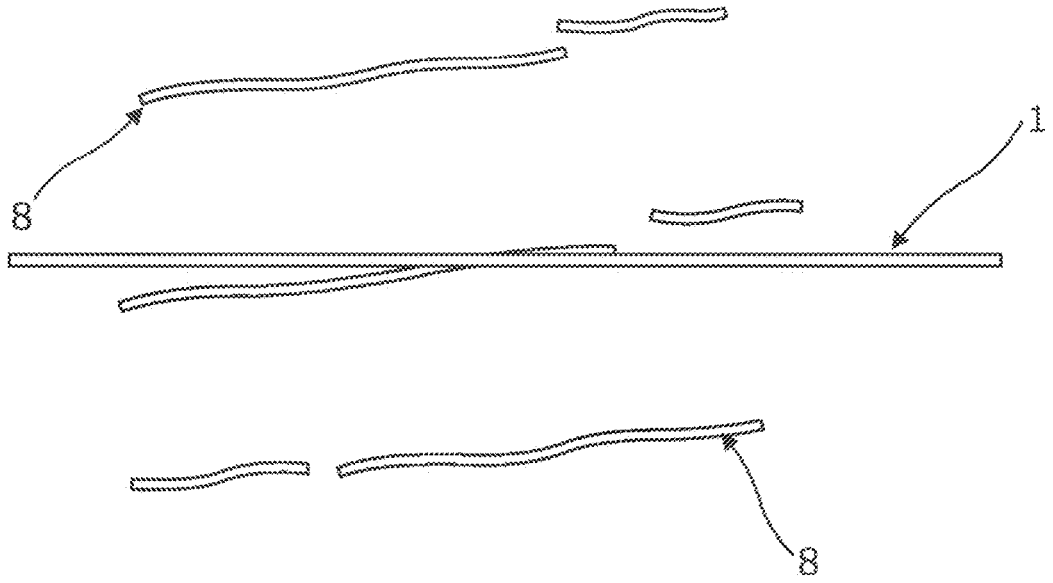
FIGS. 13*a* and 13*b* show in plan view the effect of relative orientation of stress chains and well trajectory.
Figure 13B:
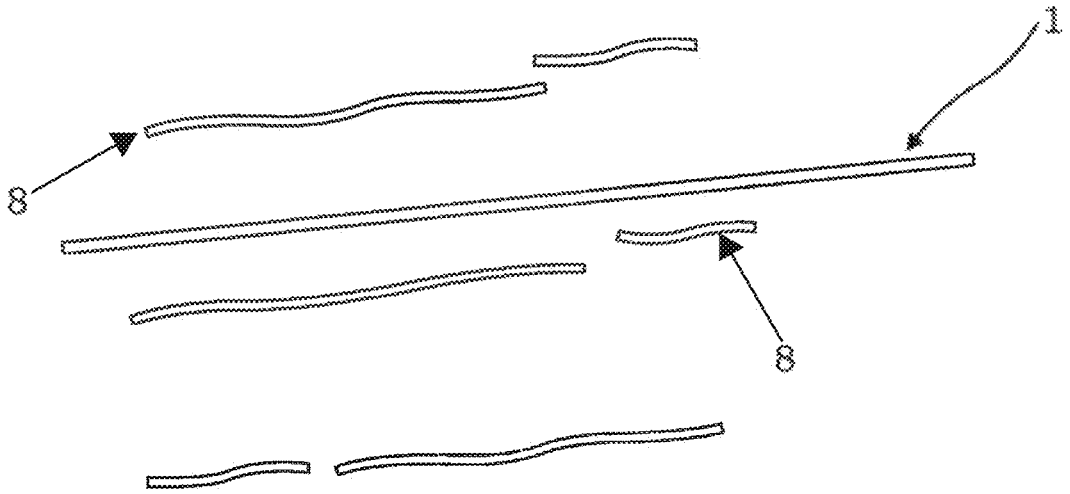

In addition to well spacing, well trajectory can also be selected more effectively, as can be seen from FIGS. 13*a*, 13*b*, 14*a* and 14*b*. FIG. 13*a* shows a wellbore 1 that is not aligned with force chains 8, whereas FIG. 13*b* shows a wellbore 1 that is well aligned with force chains 8. The wellbore 1 in FIG. 13*a* therefore sees strong variability in stress along its length, whereas the wellbore in FIG. 13*b* sees relatively little stress variation.

Figure 14A:
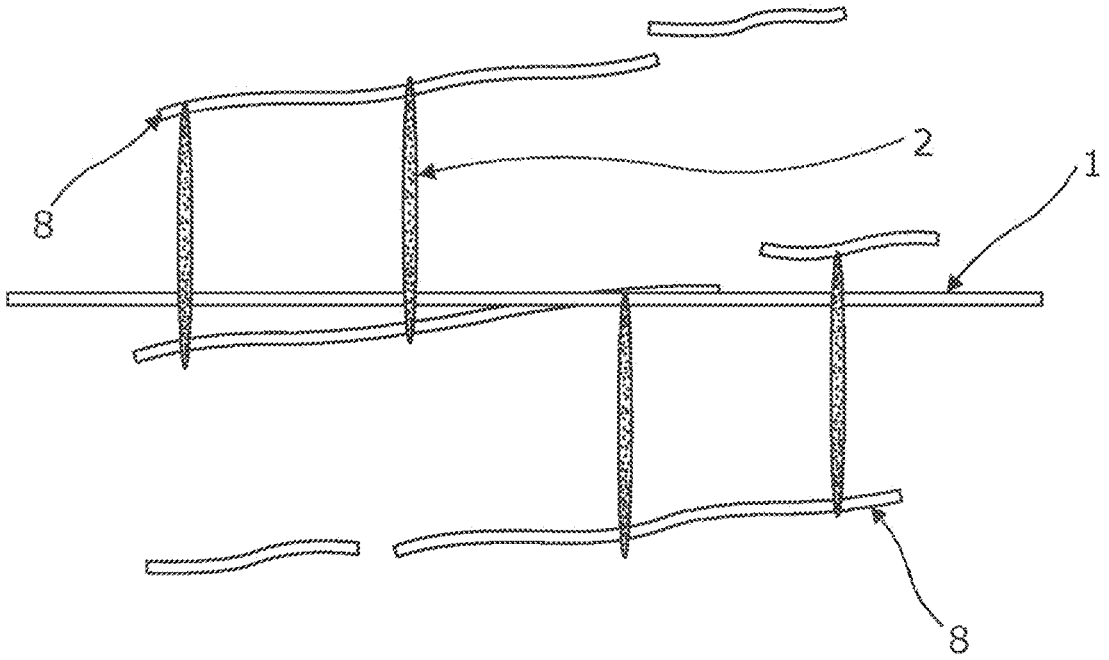
FIGS. 14*a* and 14*b* show in plan view the effect of relative orientation of stress chains and well trajectory on reservoir drainage by spaced hydraulic fractures.
Figure 14B:
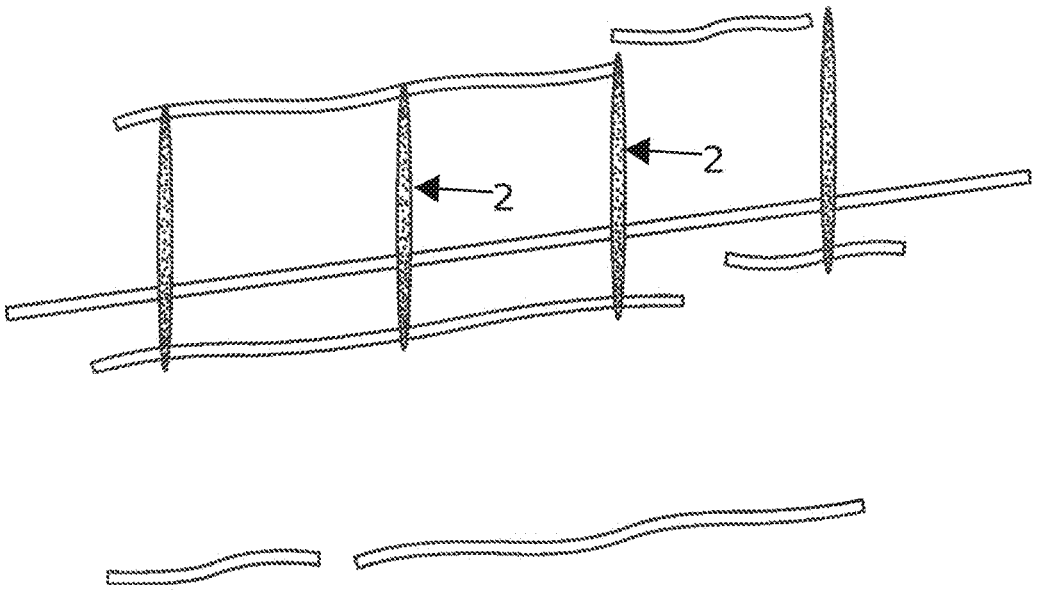

FIGS. 14*a* and 14*b* show the differences in fracture asymmetry that can result from the relative alignment between a well trajectory and force chains. In FIG. 14*a* the wellbore 1 and force chains 8 are not aligned and the fractures 2 are not only asymmetric but the asymmetry varies significantly between adjacent fractures. In the aligned case shown in FIG. 14*b*, there may well be asymmetry but this is relatively consistent between adjacent fractures 2. There is a significant risk that in the FIG. 14*a* case, the reservoir will not be effectively drained.

Figure 15:
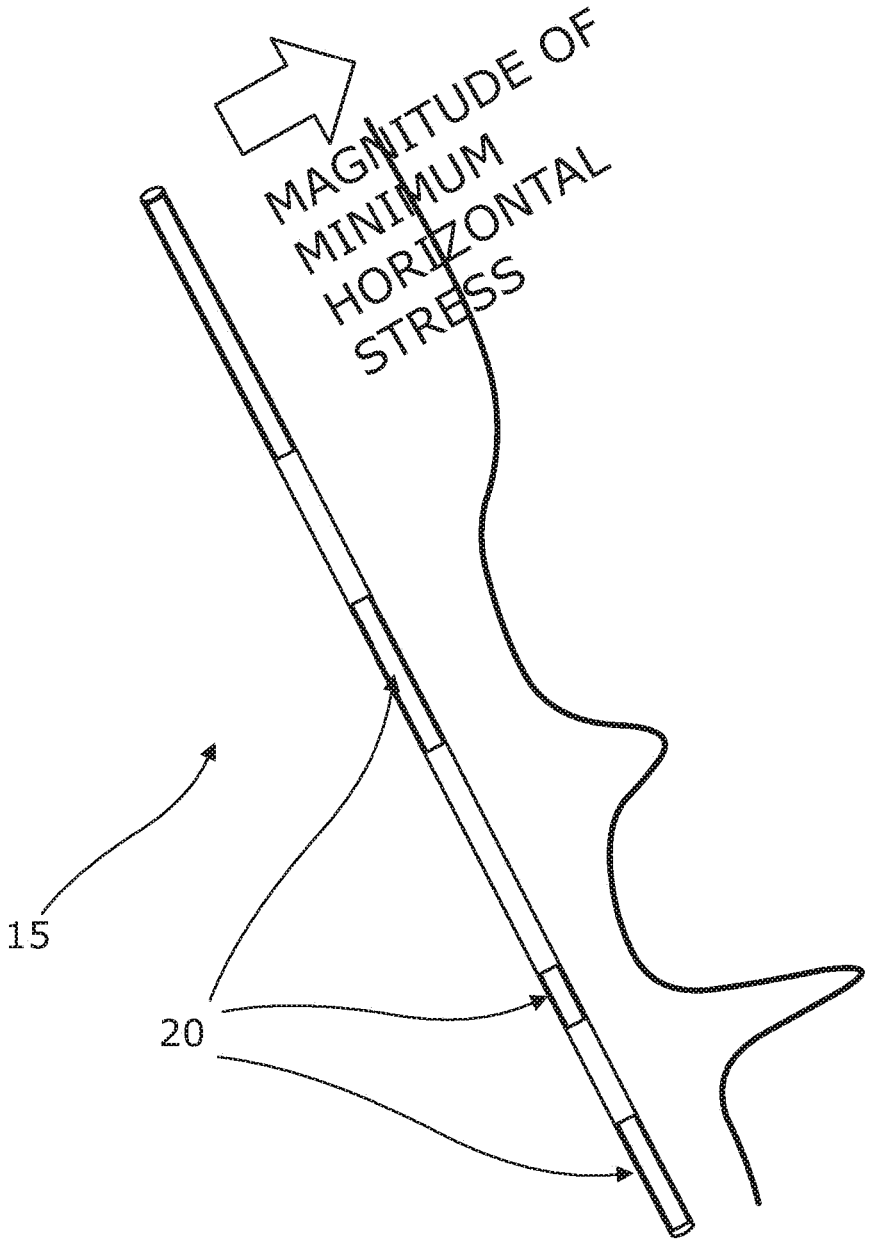
FIG. 15 shows in plan view the effect of fracturing stage length and location in the presence of stress chains according to an embodiment of the invention.

As is illustrated in FIG. 15, a significant benefit is in improved selection of hydraulic fracture stage positioning along a horizontal wellbore. Factors discussed above contribute to determining a preferred hydraulic fracture stage spacing, but it is possible to go further and identify preferred locations for perforation. FIG. 15 shows a calculated or determined magnitude of minimum horizontal stress along a wellbore 15—this identifies a number of regions 20 of approximately constant minimum horizontal stress. These regions will be particularly suitable for perforation as they will not be constrained adversely by force chains. Not only hydraulic fracture stage length but also perforation cluster locations and numbers may be determined for each stage, this perforation cluster choice typically making a compromise between fracture-fracture interference and stress chain control of lateral growth.

It is therefore an achievable goal to effect a more even distribution of hydrocarbon flow along a given multi-fractured wellbore with greater overall well productivity. This will require variably spaced rather than equally spaced hydrofractures, allowing for the force chain distribution, and will reduce the number of unproductive hydrofractures created and consequently reduce cost.

A significant incidental benefit is a reduction in the quantities of fluids and proppant used when force chains have been used to model requirements. It can be appreciated that because of the force chains, there is a natural limit to the lateral extent of hydraulic fractures. Beyond this, additional pumping results only in fracture dilation (and consequently additional stress concentrations which are detrimental to the growth of subsequent hydraulic fractures) and/or fracture height growth (which is usually undesirable, as discussed earlier). Because lateral barriers to fracture propagation have not previously been recognised, and either long fractures or large stimulated volumes have been sought, very large volumes of fluids and proppants have been used in unconventional reservoirs relative to the volumes which have been normally used in higher permeability, conventional reservoirs. In addition to the cost reduction, reduction of the quantities of fluids, proppant and pumping times reduces environmental risk.

Use of force chains in modelling has other incidental benefits—for example, it leads to improved interpretation of monitoring data such as microseismicity recorded during each fracture treatment stage.

In order to predict the distribution of the force chains, the following fracture characteristics can be used:

1) the spatial distribution of fractures (fracture density and its variation);
2) the distribution of fracture orientations;
3) the distribution of fracture length;
4) the distribution of fracture frictional (including the small-scale roughness of fractures) and cohesive strengths.

These characteristics may be interrelated. For example, fractures of a certain orientation may be mineralised (affecting their strength) whereas others at different orientations may be free of any mineral cement. The distributions of fractures having different orientations may be different—fractures with different orientations are likely to have occurred at different times.

In addition, it would be desirable to determine the so-called 'far-field' stress tensor so that it can be used as an input. There are existing procedures used in the art for describing the state of stress which can be used to achieve satisfactory results even though they do not provide the full stress tensor. Such stress description procedures normally assume that the state of stress can be described by the magnitude of the vertical stress, the magnitudes and orientations of the horizontal maximum and minimum stress and the reservoir pore fluid pressure. This approach assumes that the vertical stress and the maximum and minimum horizontal stresses are principal stresses. Uncertainty arises for a number of reasons, including limitations of the number of wellbore geometric features (breakouts and drilling-induced tensile fractures) which can be used to interpret the stress state and uncertainties inherent in the interpretation of these features including estimates of the fluid pressure (mud equivalent circulating density) in the well at the time these features were formed. Interpretation of the wellbore geometric features in itself normally carries some uncertainty. It is suggested that effective estimation of far-field stress is more complex than is generally assumed in the art, where a single proposed set of values for the magnitudes of the vertical and horizontal stresses and their orientation, and the pore pressure, is the normal product of routine interpretations of borehole features.

It is suggested that the far-field stress may vary across large regions of investigation. Extrapolation from, and interpolation between wells, can be greatly improved by geomechanical modelling of the stress history of the reservoir. This can be based on the known structural history of the region. Predictions from the stress history model should match the interpretation of present-day stress obtained at the available wellbores and/or spontaneously predicted, previously mapped fault patterns. This provides a means of testing and to some extent validation of the descriptions of stress state, though allowance should be made for a degree of uncertainty.

In fractured shale and other fractured reservoirs, the local stress state can be strongly influenced by the fractures (forming the stress chains addressed here) so that no single stress tensor is applicable. However, a range of estimates of the 'far-field' stress tensor can be combined with a description of the distribution of the fractures and their geomechanical properties, to describe the variation in the stress tensor within the reservoir using a commercial geomechanical simulator. A suitable simulator is FLAC, developed by Itasca Consulting (further details can be found at http://www.itascacg.com/software/flac).

Figure 2:
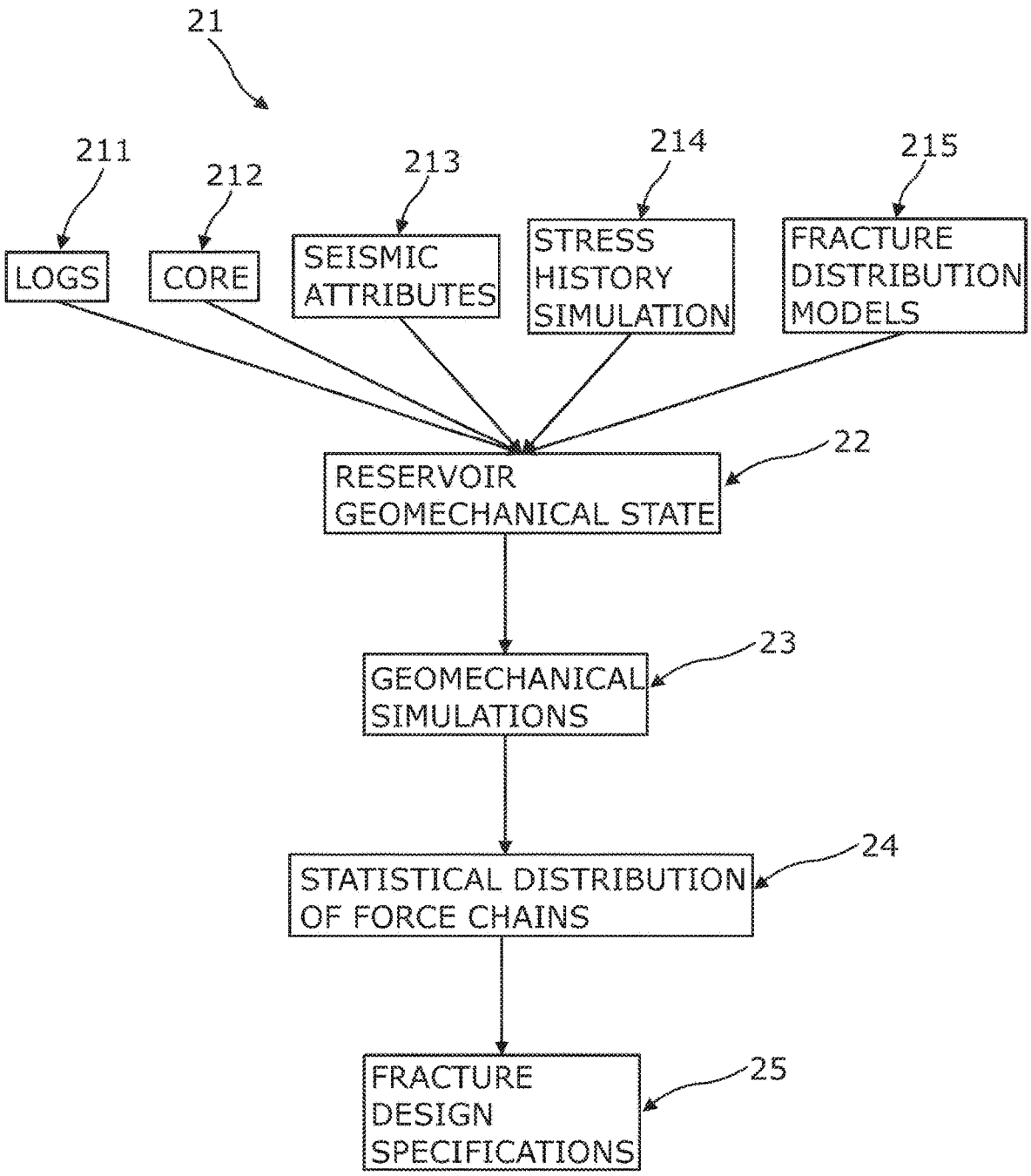
FIG. 2 illustrates process steps in a method of describing a sedimentary reservoir and designing a hydraulic fracture according to an embodiment of the invention.
Figure 3:
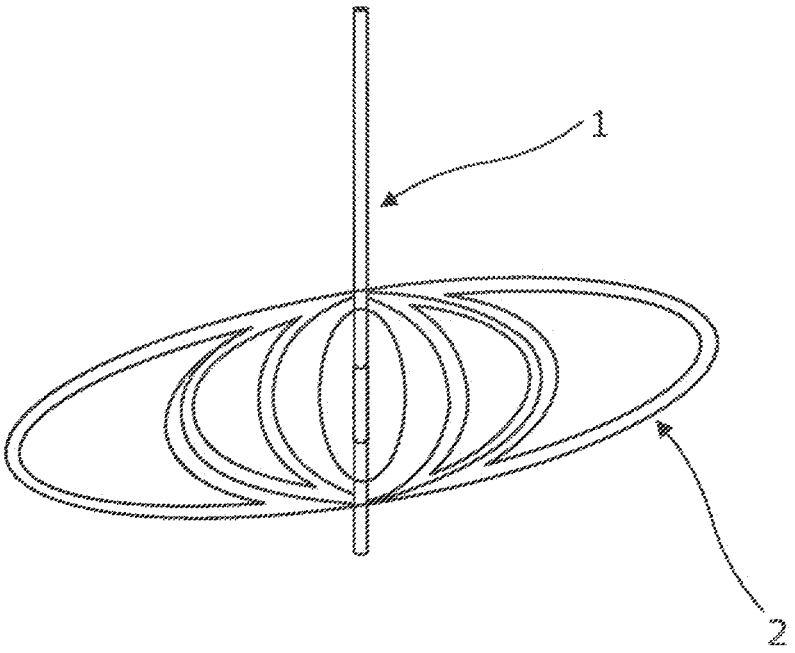
FIG. 3 illustrates propagation of a single hydraulic fracture from a vertical well.
Figure 4:
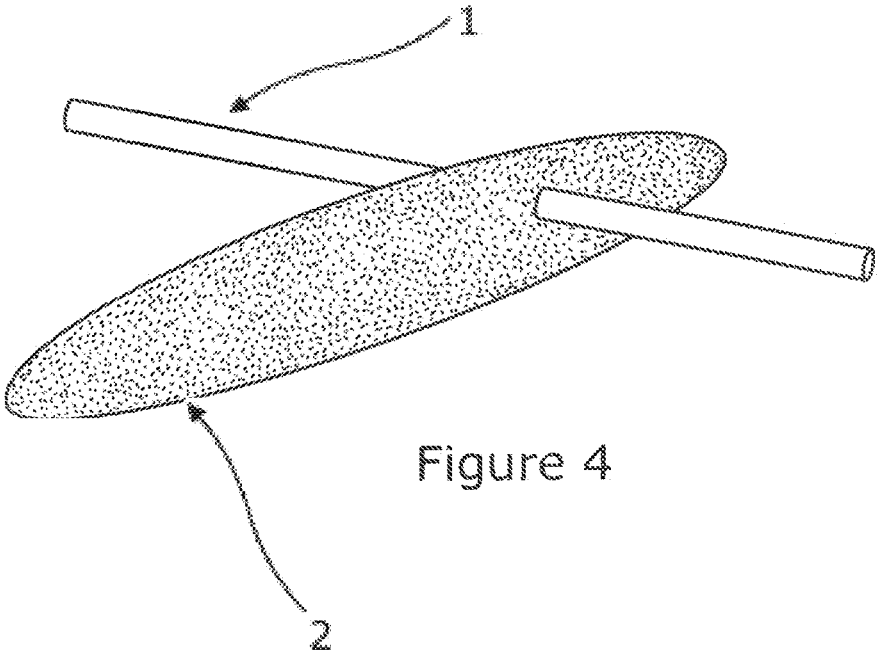
FIG. 4 illustrates an asymmetric hydraulic fracture about a horizontal well.

A process for making a reservoir description and using this reservoir description for fracture design according to an embodiment of the invention is illustrated in FIG. 2.

Figure 17:
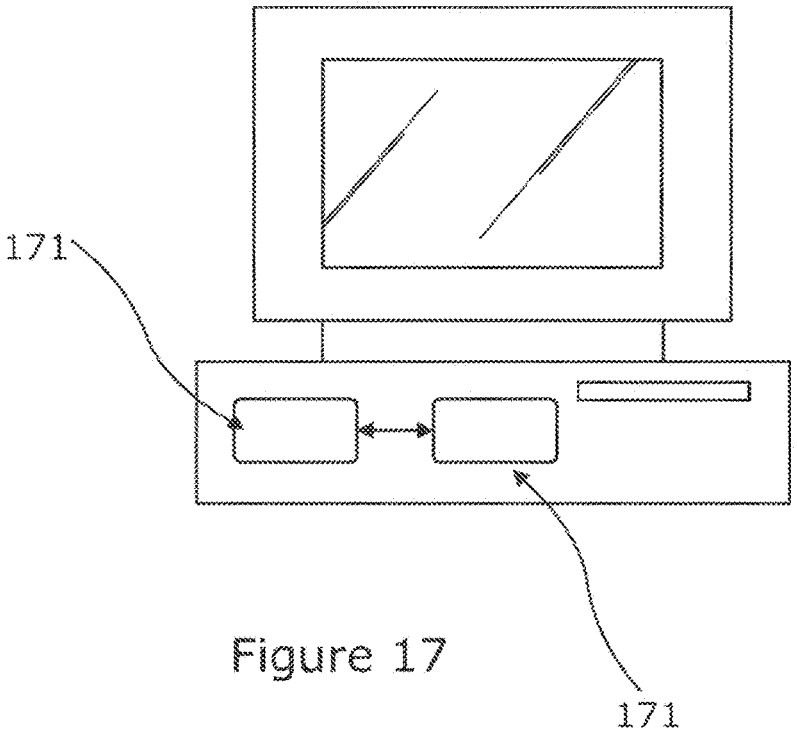
FIG. 17 shows a computer system suitable for implementing process steps according to embodiments of the invention.

This process can be implemented on a conventional computer system as shown in FIG. 17 comprising a suitably programmed processor 171 in communication with a memory 172 storing data and software.

First of all, data useful for making a reservoir description containing force chain information must be gathered 21. The data directly related to fracture characteristics are scarce and are one-dimensional in that they are values attached to particular locations. They are mainly acquired from the immediate vicinity of a well and are typically obtained from cores 212 obtaining data directly along the well bore and from image logs 211 providing resistive and acoustic imaging around the well bore). These direct data, and other petrophysical data derived from wells, can be combined statistically with three-dimensional interpretations covering a whole reservoir, or volume thereof, derived from 3D seismic data 213 (including coherency, curvature, fault recognition and rock physics-based descriptions) and models of fracture distribution 215. Together these form a probabilistic description of the distribution of geomechanical properties, including fractures. This representation together with the description of the "far field" stress state, provided as a stress history simulation 214 or otherwise, using the principles discussed above, provided an overall reservoir geomechanical state 22. This reservoir geomechanical state 22 can be used as input to a suitable geomechanical simulator (as described above) to perform geomechanical simulations 23. These geomechanical simulations, as they contain information relevant to force chain properties, can be used to predict 24 the distribution of the force chains.

In the simulation step, the distribution of the geomechanical properties of the intact rock should also be provided (not shown in FIG. 2). These are of secondary significance to the formation of force chains and can be derived from a combination of the well and seismic data using conventional methods.

A simulation process may involve modelling a reservoir in two or three dimensions, providing an estimated stress state in an elastic medium, fixing the boundary values, and then populating with fractures and equilibrating. The force (stress) chain distribution emerges rapidly on equilibration.

Figure 18:
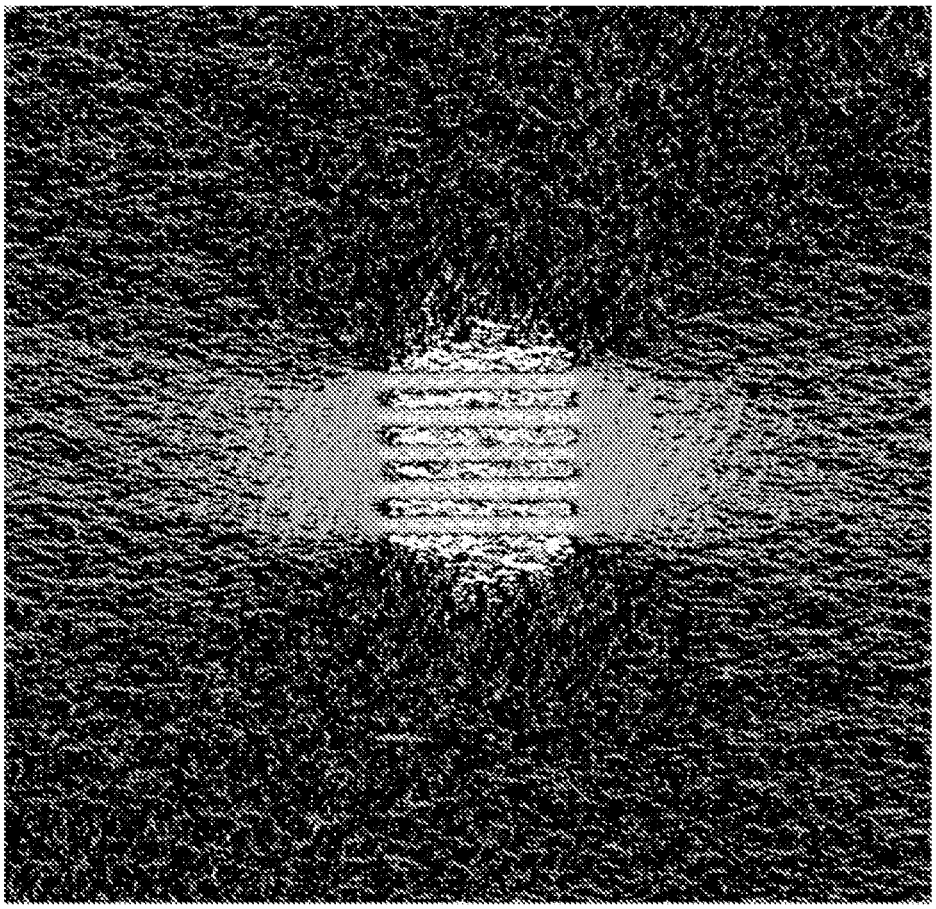
FIG. 18 shows a plan view of a reservoir with stress chains modified by horizontal wells having hydraulic fractures.
Figure 19A:
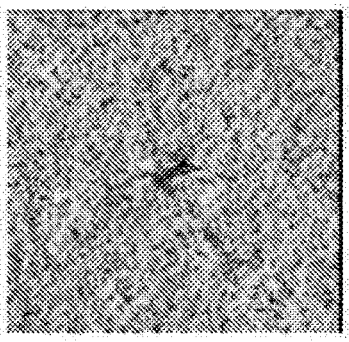
FIGS. 19*a* to 19*i* show plan views of a reservoir with progressively increased hydraulic fracturing.
Figure 19B:
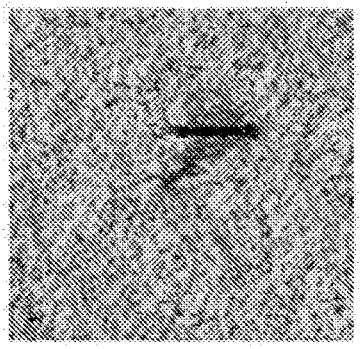
Figure 19C:
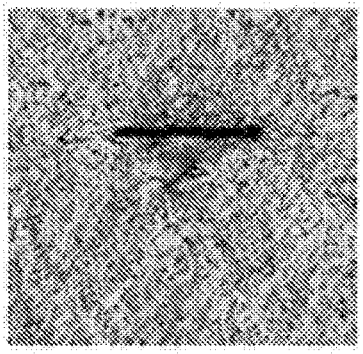
Figure 19D:
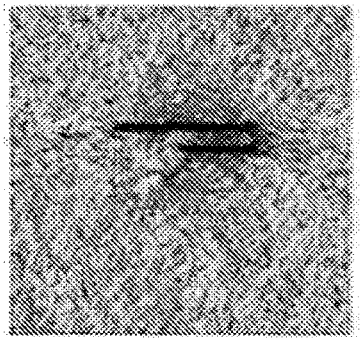
Figure 19E:
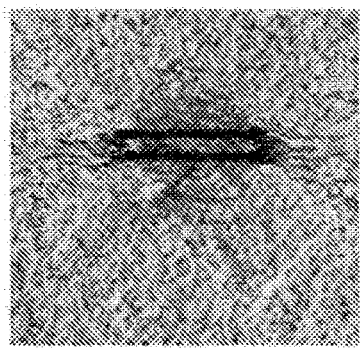
Figure 19F:
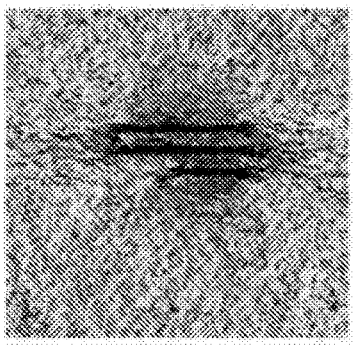
Figure 19G:
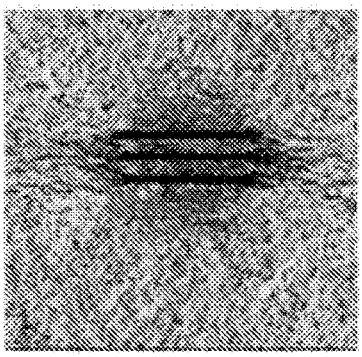
Figure 19H:
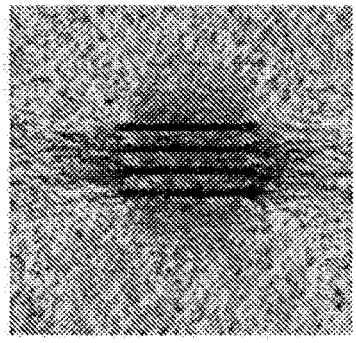
Figure 19I:
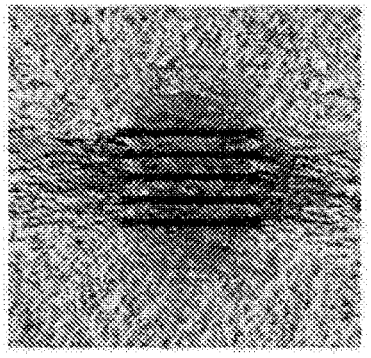

A further practical consideration is that force chains are themselves affected by hydraulic fracturing. FIG. 18 shows in simulation a plan view of a reservoir with stress chains modified by a series of horizontal wells. The plan view (extending over 5 km×5 km) shows five horizontal wells spaced 200 m apart from each other, each well having ten hydraulic fractures spaced 100 m apart. It may therefore not be sufficient to provided by description a simulation of the original reservoir, but rather a simulation that also takes into account the modification to the original reservoir that is provided or will be provided by existing or proposed hydraulic fracturing events.

This is illustrated further with regard to FIGS. 19*a* to 19*i*. These are discussed below after a brief discussion of stress concentration around fractures. Slip on a fracture displaces the rock on each side, so raising and lowering stress in a characteristic pattern well known to geophysicists. Stress chains will form as a result of interaction between local regions of high stress. A natural process causing such stress chains is mechanical action between slipped natural fractures.

The process of hydraulic fracturing will have a similar effect. For a hydraulic fracture to propagate through a chain of high stress, the fracture fluid pressure must exceed the stress transmitted along the chain so that it opens the propagating fracture. If closely spaced hydraulic fractures are successfully propagated through stress chains—as is typically necessary for multi-fractured horizontal well completion in shales—the engineered fractures change the stress state around them. The next hydrofracture along the well will grow in an environment in which the stress chains have been modified, or conceivably fundamentally changed, by earlier hydrofractures.

FIGS. 19*a* to 19*i* show a 3 km×3 km plan view of simulated successive 1 Mpa contour interval stress chain distributions as affected by hydraulic fractures leading to five horizontal wells with 10 hydraulic fractures (identical in this simulation) per well sequentially fractured from the right hand side to the left hand side of each Figure. The Figures show respectively the initial reservoir and then the same reservoir with 5, 10, 15, 20, 25, 30, 40 and 50 hydraulic fractures. A single fault crosses the central well at its midpoint, illustrating the effect of fault structures on reservoir chain distribution.

In the simulation shown, the area shown is the inner area of a 5 km×5 km simulated resevoir section at a depth of 3 km subject to strike slip conditions (maximum applied total stress 81.4 MPa aligned top to bottom, minimum applied horizontal total stress 50.9 MPa aligned side to side, where top to bottom and side to side apply to the plane of the plan views as presented in the Figures). The hydraulic fractures are of approximately 26 mm aperture at the wellbore. The reservoir is allowed to approach equilibrium under displacement-controlled boundary conditions. The simulated reservoir is 50% naturally fractured, the simulation using homogeneous elastic properties, ubiquitous joint constitutive properties and three sets of normally distributed ubiquitous joint zones.

The simulation shows that stress chains may be concentrated at the end of multi-fractured horizontal wells. FIGS. 19*a* to 19*i* show 1 MPa interval filled contours of effective stress parallel to the applied (regional) minimum stress. Pore pressure is assumed constant, so effective stress changes are equal to total stress changes. It is found that for relatively typical well and hydrofracture spacings and fracture pressures, the stresses induced by fracture completion may combine to form a new or substantially modified set of stress chains in the vicinity of each end of the well. It should be noted that wells are frequently drilled in 180° opposed directions from a common pad—in this case, the new chain structure following fracturing of the first drilled set of wells may have sufficient influence on the reservoir chain distributions to affect hydraulic fracture propagation at least for the proximate end of the second set of wells, and so should be considered in fracture stimulation designs.

The relationships between the distribution and geomechanical characteristics of the fractures and the controlling geological parameters are uncertain. Thus deterministic approaches should not be used at this point (as there is not one definite solution to find) and only probabilistic modelling should be used to assess the uncertainties. Such methods have been developed within the industry for purposes of predicting the distribution of fractures within a reservoir (see Gauthier et al, "Integrated fractured reservoir characterization: a case study in a North Africa field", SPE 65118).

This force chain distribution 24 can then be used to design a pattern of fractures 25 that can be implemented in a hydraulic fracturing process as shown in FIG. 1. Further discussion of specific process steps above follows below.

As indicated above, fractured reservoir descriptions are known, but in the embodiments of the invention they are augmented by geomechanical information such as frictional and cohesive strength and their distributions. This additional requirement may be offset to some extent in shale reservoir developments by the normal practice of drilling horizontally or sub-horizontally within the shale reservoir. Horizontal wells more frequently intersect subvertical fractures—subvertical or high-angle fractures occur more frequently than low angle fractures. In shale reservoirs, horizontal wells are drilled in close proximity to one another, typically spaced approximately at two hydraulic fracture half-lengths.

Geomechanical characterisation of the fractures is based upon rock physics derived from the composition of the host rock. This benefits from knowledge of the diagenetic history of the reservoir and timing of fracture development. The reservoir diagenetic history can be deduced from core measurements, burial history and other geological knowledge normally available. The timing of fracture development can be deduced from the structural history. A library relating rock geomechanical properties to the petrophysical composition of the host rock and diagenetic mineral fracture filling where applicable can be compiled to reduce uncertainty.

A number of approaches and observations may be used to reduce uncertainty and so provide a more reliable reservoir description. As noted in McVay, D. "Industry needs re-education in uncertainty assessment", Journal of Petroleum Technology, February 2015, the reliability of probabilistic forecasts can only be judged when a group of forecasts are available. Multiply fractured wells, of which typically there are many drilled in close proximity to one another, may be well suited to uncertainty assessment. In some circumstances, the necessary geomechanical information may also be aided by production data from nearby producing wells which are sensitive to the intersection of hydraulic fractures with natural fractures. Qualitative and sometimes quantitative information can be acquired by microseismic monitoring during fracture propagation which may also reduce uncertainty.

The magnitude of the minimum horizontal stress at an injection point can be determined by injecting a small volume of fluid at a low rate before the main hydraulic fracture treatment and observing the pressure decay—a diagnostic fracture injection test (DFIT).

The magnitude of the minimum horizontal stress varies with lithology and according to the force chains. The variation of the minimum horizontal stress with lithology may be estimated from geophysical logs using standard methods, though this makes no allowance for the force chains. The uncertainty in the predicted distribution of the stress chains, and consequently the design hydraulic fracture lengths, can however be reduced by such measurements. Alternatively, the stress variation can be interpreted to predict the presence of fractures remote from the wellbore which give rise to the stress chains which may be encountered where they cross the wellbore.

Other observations which can be used to reduce uncertainty include the inferred relative rates of flow from each stage when the well is put on production using monitoring techniques such as distributed temperature sensing. As the skilled person will appreciate, there are numerous interrelated observations (not all shown in FIG. 2), and so numerous ways of using additional information to reduce the uncertainty.

The determination of the stress chain distribution can in fact be used to improve measurement of minimum horizontal stress (MHS) in a rock region (potentially extending across several layers in a region of interest) with depth. There are various approaches available for determining MHS. Conventional approaches calculate MHS from well log data—a review of these methods is found in Lisa Song, "Measurement of Minimum Horizontal Stress from Logging and Drilling Data in Unconventional Oil and Gas", M.Sc. thesis for the University of Calgary, pages 49-54. These measurements use in situ point stress determinations or interpretations of borehole features in terms of stress.

In addition to electric log data for continuous stress measurements, image log data may provide stress estimations from geometric features (such as breakout) in wellbore walls. This approach can provide more data, but the resulting data points require to a varying degree an interpretation of wellbore features.

These measurements typically use a simple algorithmic approach in which the rock layer is assumed to be uniformly elastic and subject to a uniform strain attributable to tectonic movements. Variations in the computed MHS are then derived from algorithms that relate properties measurable by logs to rock elastic properties, and elastic properties to in situ stress state. The resulting plot of MHS is then generally "calibrated" by achieving a best fit with scattered in situ point stress determinations (typically from electric logs) or interpretation of borehole features in terms of stress (typically from image logs).

Various examples show the approaches taken to MHS determination for unconventional reservoirs. One such example is in Song at page 89 with respect to FIG. 5.22, which shows a curve of log-derived MHS with only a single stress determination for calibration. Another example is found in Jiminez et al., "Calibration of Well Logs with Mini-Frac Data for Estimating the Minimum Horizontal Stress in the Tight-Gas Monteith Formation of the Western Canada Sedimentary Basin: A Case Study", May 2015 SPE Production and Operations pp. 110-120, with particular respect to FIGS. 21 and 22 which compare calculated MHS with a direct determination. The position is similar with respect to image logs—a preliminary technical report by Baker Hughes Incorporated entitled "Wellbore Failure Analysis and Geomechanical Modelling in the Bowland Shales, Blackpool, UK" made available through www.cuadrillaresources.com/ shows in FIG. 31 an interpretation of a continuous curve with various estimations of the MHS and observations over a 9000 ft interval. Use of wellbore features to "calibrate" the geomechanical interpretation is shown in FIG. 35.

Green, C. A. "Hydraulic fracture model sensitivity analysis of massively stacked lenticular reservoirs in the Mesaverde formation, Southern Piceance Basin, Colorado." MSc thesis for Colorado School of Mines, sets out a recommended methodology for creating an accurate hydraulic fracture model using stress information (see for example page 81). Cantini, S. et al "Integrated Log Interpretation Approach for Underground Gas Storage Characterization" in SPE EUROPEC 2010, Barcelona 14-17 Jun. 2010 goes through the process of estimating minimum stress magnitude from logs, with FIG. 9 showing a continuous curve of the minimum horizontal stress. Parra, P. A. et al "Unconventional Reservoir Development in Mexico: Lessons Learned From the First Exploratory Wells", SPE 164545, shows an example of a calculated stress profile in FIG. 12 using a limited number of calibration points.

In the case of an unconventional reservoir, the assumptions used in the approaches above may not be sound. This may be particularly problematic where only a limited number of in situ point stress determinations are made, as can be seen from the examples is often the case. In practice, it is often found that the one or more of the relatively few MHS points derived from an in situ measurement differs markedly from the "calibrated" curve. A likely cause for this discrepancy is stress chain distribution.

Various approaches can be used to improve MHS measurement from the knowledge that stress chain distribution—and more generally, variation attributable to local structures (such as folds, faults and other fractures—in some cases identifiable from seismic data or inelastic behaviour). Even without calculation of the magnitude of MHS variation, such outlier points could be recognised as likely to be the result of local features for which the assumptions made in the MHS determination are not correct as a result of local features, and so these outlier points could be removed from the data set and not used to displace the log-derived curve in a calibration process. However, quantitative estimates can also be made by using geomechanical modelling as shown above in the context of reservoir description—these can allow the potential range of MHS variation to be quantified and placed on the log-derived profile instead of a single point, thereby improving the quality of the results.

Improved determinations of MHS can be used in a full reservoir description, but can also be used as a specific element in fracture design, or for any other purpose where MHS data is needed to design subsurface operations.

Specific approaches to the design of hydraulic fractures using a reservoir description such as set out above will now be described in detail below.

The options for hydraulic fracture design are mainly the location of the injection point or points (perforation cluster or clusters), the viscosity of the fracturing fluid, the volumes of fracturing fluid and proppant, the scheduling of the proppant injection and the rate of injection and the type of proppant. Stress chains will influence the aperture of the hydraulic fracture at the wellbore (though length or height of the fracture will form the primary control) and the maximum length of fracture which can be achieved without undesirable height growth.

Force chains and natural fractures are intimately related. Intersection of hydraulic fractures and natural fractures in unconventional reservoirs is typically sought by operators to maximise the fracture surface area available for flow from the matrix reservoir to the well. From this point of view, the presence of natural fractures in an unconventional reservoir is considered to be desirable. However, the recognition of the existence of force chains as discussed here reveals that certain combinations of stress state and natural fractures are detrimental to the lateral propagation of a hydraulic fracture. Therefore, the presence of natural fractures is not always beneficial and existing approaches to fracture design for unconventional reservoirs are not appropriate, and can lead to poor decisions of where to make fractures, of what volumes of fluid and proppant to use, or even of choice of which reservoir to fracture. The method presented here for predicting the force chain distribution will allow operators to rank reservoirs or regions of reservoirs of different qualities, along with other reservoir qualities, allowing for both predictions of the natural fracture distribution and the force chains.

One issue in practical fracture design is effective linkage between the hydraulic fracture and the natural fractures in the rock to achieve effective drainage. One strategy that may be used to this is early injection of proppant to achieve a modified tip screen out to keep open an aperture between the hydraulic fracture and an adjoining natural fracture—a desirable purpose is to achieve good hydraulic conductivity between accessed natural fractures and the wellbore.

As discussed above with reference to FIG. 1, in unconventional reservoirs there are typically multiple fracture stages each with their own perforation point or cluster. It has been claimed that selection of fracture stages on the basis of homogeneity of the minimum horizontal stress along the stage and such so-called "engineered" wells may achieve greater well productivity as is discussed in Gerdom et al, "Geomechanics key in Marcellus wells", The American Oil & Gas Reporter, March 2013. Force chains can be the product of slip on natural fractures subjected to the present day stress state or stored ("fossil") as a result of slip on natural fractures when subjected to a previous stress state in the geological past. The broad pattern of force chains is of a broadly subparallel, series of discontinuous "ribbons". It is found that the force chains may not be parallel to the minimum horizontal stress. The heterogeneity of stress state along a well depends upon the intersection with the force chains, which will vary depending upon the positioning of the well and its azimuth (see FIGS. 13*a* and 13*b*). Where fractures are not clearly related to a local geological driver (such as a fault) and distributed in a similar manner over a region to be drilled, the well cannot be positioned to avoid the chains in advance because only the distribution, not the precise location, of the force chains is known in advance. The azimuth of the well, relative to the known azimuth of the force chains, can however be selected by the operator based on the variation of the probability of force chain/well intersections to minimise the heterogeneity of stress along the well.

Operators will be able to specify the volume of fluid to be pumped. Having a geomechanical description of the reservoir which includes the distribution of force chains will directly allow operators to specify the volume of fluid which can be pumped without the laterally growing hydrofracture attempting to grow through a stress chain. It is advantageous to do this not only from the inherent benefits of reducing fluid volumes but also because if an additional volume of fluid were pumped, this would promote undesirable fracture height growth. This can be perceived as a risk-based design basis, balancing the probability of intersecting a force chain as the fracture grows laterally and the risk of fracture height growth against the larger area of reservoir intersection which is desirable from the point of view of reservoir drainage.

The probability of intersecting a stress chain along the wellbore, or of the wellbore at any given point being close to a stress chain, resulting in a relatively small hydraulic fracture aperture at the wellbore, can also be predicted statistically using a reservoir description as provided by embodiments of the invention.

Given the distribution of force chains, it is possible to statistically predict the distance from the injection point to the nearest fracture-blunting force chain. In turn, this allows calculation of the probable fracture aperture at the wellbore and its effect on well productivity. If a force chain is present in the vicinity of the wellbore such that hydraulic fracture is asymmetric about the wellbore and the injection point is near to the fracture tip where it meets the force chain, the fracture aperture will be less than that which can be achieved if the fracture grows elliptically about the injection point with the injection point as the centre of the ellipse (FIG. 5). This may in turn influence the operator's selection of fracture fluid viscosity. Gelled fracture fluids give rise to higher apertures than slickwater fracture fluids which may give rise to longer fractures in unfractured rock. In fractured rock, slickwater more easily penetrates the fractures thus forming a wider zone of connected surface area than would develop in the absence of fractures. The force chain distribution may dictate that shorter, fatter fractures, limited by the distance between force chains, may lead to the highest well productivities.

Specification of proppant quantities and scheduling can also be improved by allowing for the distribution of force chains.

With increasing quantities of additional information, the uncertainty in the distribution of force chains can be reduced. This additional information includes observations of the minimum horizontal stress in adjacent wells and in previous fracture stages of the current well and its distribution. It may include more qualitative information such as microseismic event distribution from previous hydraulic fracture treatments nearby (either from an adjacent well or the current well) or well productivity data by stage from adjacent wells.

In addition to the design specifications discussed in the preceding paragraph, a geomechanical description which includes the force chain distribution can be used to aid the specification of fracture stage location and length and perforation cluster distribution. If the objective is to limit the stress heterogeneity within a single stage (discussed in Gerdom et al. cited above), predictions of the force chains can be used in selection of stage length. It is common practice to perforate at multiple points (say 2 to 5 locations) per fracture stage. Given the variation of normal stress parallel to the wellbore to be expected in fractured shales, it is unlikely that each perforation cluster will take a similar amount of fracturing fluid during injection. Indeed, recent well measurements have demonstrated the dominance of one of the perforation clusters in stages completed using five clusters of perforations (Rassenfoss, S., "The wide divide between fracturing plans and reality", Journal of Petroleum Technology, April 2016).

Figure 16:
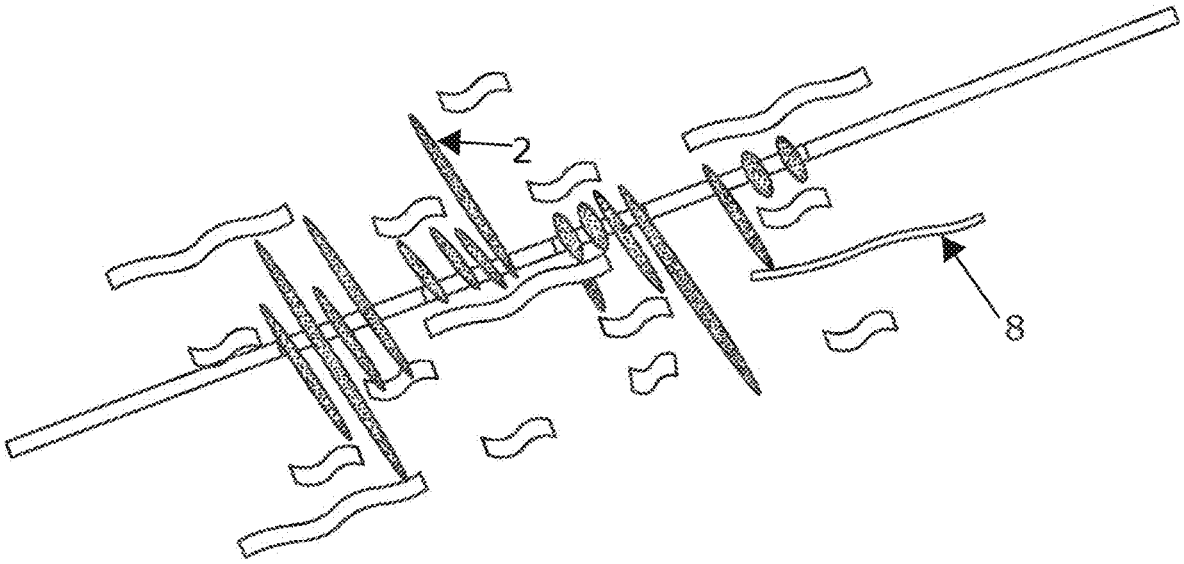
FIG. 16 illustrates in plan view the effect of stress chains on hydraulic fracture penetration.

FIG. 16 shows the influence of high magnitude stress chains on fracture length and its consequences. It can be established that there is mutual interference between closely spaced fractures 2, but that where stress chains are closely spaced, there is a benefit in providing more perforation clusters (and so potential fracture initiation points), as this improves the chances of achieving deep penetration into the layer. It can be seen that an understanding of the distribution of the force chains 8 can be used, in conjunction with the influence of sedimentary layering on stress, to select cluster locations within the individual stages. There is, for example, a relationship present between the concentration of fractures 2 and force chain distribution that may be used to achieve effective reservoir drainage.

As is shown above, embodiments of the invention may be used to describe sedimentary reservoirs, in particular to identify a predicted effect of hydraulic fracture, and to design suitable hydraulic fracturing accordingly. The skilled person will appreciate that the approach set out here has broader application, for example to description of the geomechanical behaviour of rock layers for other reasons such as determination of induced seismicity. As discussed above, the approach taught here can be used in dynamic as well as static modelling Modifications and improvements may be made to the foregoing without departing from the spirit and scope of the invention.

The invention claimed is:

1. A method of hydraulic fracturing of a hydrocarbon reservoir in a rock layer, the method comprising:

predicting a distribution of a plurality of stress chains that are located within the rock layer and which have been created by interaction between slipped natural fractures in the hydrocarbon reservoir;

providing a reservoir description for the hydrocarbon reservoir, the reservoir description comprising a distribution of stresses within the rock layer affecting propagation of a hydraulic fracture, the distribution of stresses including the predicted distribution of stress chains and comprising a two-dimensional distribution laterally within the rock layer and a distribution normal to the rock layer;

calculating a fracture plan for hydraulic fracture of the hydrocarbon reservoir according to the predicted distribution of stress chains in the reservoir description to provide one or more predetermined fracture properties; and hydraulic fracturing of the hydrocarbon reservoir according to the fracture plan.

2. The method of claim 1, wherein the distribution of the plurality of stress chains comprises channels of high stress.

3. The method of claim 1, wherein the fracture plan comprises location of a plurality of puncturing points to initiate hydraulic fracturing.

4. The method of claim 1, wherein the fracture plan comprises a plurality of fracture stages wherein each fracture stage is to be fractured separately, the fracture plan comprising a start point and an end point for each fracture stage.

5. The method of claim 4, wherein the fracture plan comprises location of one or more puncturing points within each fracture stage.

6. The method of claim 1, wherein the fracture plan comprises determining a drillbore direction in the rock layer.

7. The method of claim 6, wherein the drillbore direction is substantially parallel to channels of high stress.

8. The method of claim 1, wherein predicting the distribution of stress chains comprises determining a geomechanical state for the hydrocarbon reservoir and performing geomechanical simulations to determine a probabilistic distribution of the plurality of stress chains.

9. The method of claim 8, wherein the geomechanical state is determined from data including drilling logs and core samples.

10. The method of claim 8, wherein the geomechanical state is determined from data including a stress history simulation.

11. The method of claim 8, wherein the geomechanical state is determined from data including fracture distribution models.

12. The method of claim 8, wherein the geomechanical state is partly determined by data from adjacent wells.

13. The method of claim 8, wherein the geomechanical state is partly determined by adjacent hydraulic fractures.

14. The method of claim 13, wherein said adjacent hydraulic fractures comprise fractures in the fracture plan.

15. The method of claim 1, wherein the rock layer is a sedimentary layer.

16. The method of claim 15, wherein the sedimentary layer is a shale layer.

17. A method of hydraulic fracturing of a hydrocarbon reservoir in a rock layer, the method comprising:

providing a reservoir description for the hydrocarbon reservoir, the reservoir description comprising a distribution of stresses within a rock layer affecting propagation of a hydraulic fracture, wherein providing the reservoir description comprises:

interpreting from in situ measurements an original set of stress values at a plurality of points in the rock region;

determining the distribution of stresses in the rock region with depth; and determining a modified set of stress values by applying the determined distribution of stresses in the rock region with depth to the original set of stress values; and calibrating the stress values in the modified set of stress values to determine a minimum horizontal stress in the rock region with depth;

calculating a fracture plan for hydraulic fracture of the hydrocarbon reservoir according to the distribution of stresses in the reservoir description to provide one or more predetermined fracture properties; and hydraulic fracturing of the hydrocarbon reservoir according to the fracture plan.

18. The method of claim 17, wherein providing the modified stress values comprises providing an uncertainty for the stress values in the modified set.

19. The method of claim 17, wherein providing the modified stress values comprises removing anomalous stress values from the modified set.

* * * * *